US006885385B2

(12) United States Patent
Ouchi et al.

(10) Patent No.: US 6,885,385 B2
(45) Date of Patent: Apr. 26, 2005

(54) IMAGE DISPLAY APPARATUS

(75) Inventors: Takayuki Ouchi, Hitachi (JP); Yoshiyuki Kaneko, Hachioji (JP); Toshihiro Satou, Mobara (JP); Yoshiro Mikami, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 660 days.

(21) Appl. No.: 09/938,541

(22) Filed: Aug. 27, 2001

(65) Prior Publication Data

US 2002/0140712 A1 Oct. 3, 2002

(30) Foreign Application Priority Data

Mar. 30, 2001 (JP) ..... 2001-098862

(51) Int. Cl.[7] ..... G09G 3/36
(52) U.S. Cl. ..... 345/690; 345/100; 345/204
(58) Field of Search ..... 345/55, 60–63, 345/82, 87–89, 98–100, 204, 690

(56) References Cited

U.S. PATENT DOCUMENTS 5,623,278 A * 4/1997 Okada et al. ..... 345/99
5,719,591 A * 2/1998 Callahan et al. ..... 345/98
5,973,660 A * 10/1999 Hashimoto ..... 345/98
6,380,920 B1 * 4/2002 Ozawa ..... 345/100
2002/0027551 A1 * 3/2002 Nitta et al. ..... 345/204

OTHER PUBLICATIONS

"Half Gradation Dynamic Image Display by AC Type Plasma Display", Institute of Television Engineers, Display System Seminar Material, 11–4, Mar. 12, 1973 pp. 1–10.

* cited by examiner

*Primary Examiner*—Regina Liang
(74) *Attorney, Agent, or Firm*—Antonelli, Terry, Stout & Kraus, LLP

(57) ABSTRACT

An image display apparatus includes a display having data holding function, a vertical drive circuit sequentially and selectively scanning matrix form display elements, and a horizontal drive circuit writing a voltage among binary voltage preliminarily assigned depending upon the digital data of the image signal. The horizontal drive circuit and the vertical drive circuit are operated for performing selective scan of respective display element for at least m times in one frame period. The vertical drive circuit is constituted of n number of sequence circuits and logic operation circuits for outputs of the sequence circuits, where n is smaller than m, a period from inputting to the sequence circuit to outputting from the final stage being less than or equal to half of one frame period, and at least one of the sequence circuits being used with selectively inputting a plurality of inputs.

12 Claims, 23 Drawing Sheets

IMAGE DISPLAY APPARATUS

BACKGROUND OF THE INVENTION

1. Field of the Invention

The present invention relates generally to an active matrix type image display apparatus. More particularly, the invention relates to an image display apparatus which holds a signal voltage written in a given selected period even out of the selected period and controls electrooptic characteristics of display element by the signal voltage. Further particularly, the invention relates to an image display apparatus performing a multiple gradation display of an image by controlling a holding period of the signal voltage depending upon a video signal.

2. Description of the Related Art

In the recent years, associating with arrival of advanced information society, demand for personal computer, portable information terminal, information communication equipment or composite produce thereof is growing. For these products, thin, light weight and high response display is suitable and a display apparatus, such as self-luminous type organic LED element (OLED) or the like, has been employed.

Pixel of the conventional organic LED display apparatus is constructed as illustrated in FIGS. 21A and 21B. In FIG. 21A, a first thin film transistor (TFT) Tsw 23 is connected at each intersection of a gate line 22 and a data line 21. To the first TFT Tsw 23, a capacitor Cs 25 for storing data and a second thin film transistor Tdr 24 for controlling a current to be supplied to an organic LED 26 are connected.

Waveforms for driving the first TFT Tsw 23 and the second TFT Tdr 24 are as shown in FIG. 21B. A current depending upon a data signal Vsig 28 is applied to a gate electrode of the second TFT via the first TFT which is turned ON by a gate voltage Vgh 29. By a signal voltage applied to a gate of the second TFT, a conductivity of the second TFT is determined. A voltage Vdd applied to a current supply line 27 is divided between TFT and an organic LED element as load element to determine a current flowing through the organic LED element. Here, in a construction where Vsig takes multiple values, it is required that a characteristics of the second TFT is uniform over entire display region of the display apparatus. However, due to non-uniformity of electrical characteristics of the TFT which is formed an active layer by amorphous silicon, difficulty is encountered in satisfying the foregoing demand.

In order to solve this problem, it has been proposed a digital drive system, in which the second TFT is used as switch to take a current flowing through the organic LED element as binary value of ON and OFF. Tone expression is realized by controlling the current to flow the current. One of known example has been disclosed in JP-A-10-214060.

A diagram of driving is shown in FIG. 22. A vertical axis of FIG. 22 represents a position of scanning line in vertical direction and a horizontal axis is a time. FIG. 22 shows driving of the display apparatus for one frame. In driving by the prior art, one frame period is divided into four sub-frames. In each sub-frame, vertical scanning period having a length common to all sub-frames and luminous periods having length weighted with weighting coefficients 1, 2, . . . $2^4$=64, per each sub-frame.

As set forth above, by a system of separating the vertical scanning period and the luminous period, vertical scanning period cannot be used for luminous to shorten luminous period occupied in one frame. In order to certainly obtain luminous period, the vertical scanning period has to be made shorter. However, since ON period of Tsw substantially correspond to vertical scanning period/the number of vertical scanning lines m, sufficiently large vertical scanning period becomes necessary for certainly obtaining ON period in consideration of wiring capacity, resistance and so forth specific to active matrix. For example, in case of displaying of eight sub-frames, about 1 ms of vertical scanning period is expected per one sub-frame. In this case, a period to be used for luminescence becomes about 8 ms which is substantially half of one frame. Furthermore, in such case, it is required that one vertical scan is sixteen times the high speed than normal scanning speed.

This problem may be solved by multiplexing vertical scan to progress vertical scan and luminescence simultaneously. At this time, driving diagram is shown in FIG. 23. FIG. 23 shows an example at 3-bit, in which is shown a condition where three vertical scan and display are progressed. Basic concept of the driving method has been suggested in "Half-tone Moving Picture Display by AC type Plasma Display", Institute of Television Engineers, Display System Seminar Material 11-4, Mar. 12, 1973, and Japanese Patent No. 2954329 applied for active matrix liquid crystal. However, a construction for actually implementing the driving method of vertical multiplexing has not be disclosed.

Upon performing high definition and multiple gradation display using digital data, it becomes necessary to increase operation speed of the driving circuit and to increase circuit scale of the driving circuit according to increase of number of data. Therefore, progress of increasing of display density and increasing of gradation levels to cause increasing of power consumption. As a solution for this, lowering of power consumption is desired.

On the other hand, in the method for controlling On/OFF display per each frame with dividing display period into several sub-frames, lowering of picture quality of the moving picture for admixingly presenting data between series of frames when moving picture display, such as television or the like, is to be performed.

SUMMARY OF THE INVENTION

An object of the present invention to provide an image display apparatus which is constructed for high definition image display by digital driving and has a construction to reduce circuit scale with restricting increasing of power consumption while number of gradation levels is increased.

In order to accomplish the above-mentioned object, in an active matrix type image display apparatus, vertical scan is multiplexed to simultaneously progress display period and vertical scanning period and whereby to realize high image quality digital drive signal.

In the present invention, for the number of m-bit digital data, a plurality of bits of digital data are applied to n (n<m) in number of sequence circuits to perform logic operation for the outputs of the sequence circuits to define a voltage condition of one stage of vertical scanning line to multiplex the same, and at least one of the sequence circuits selectively is input a plurality of bit data, and/or digital data is applied to n in number of line latch circuits in parallel to output the digital data in synchronism with the multiplexed vertical scan, and at least one of the line latch circuits is selectively input a plurality of bit data.

By this, with restricting circuit scale and suppressing power consumption, m bit gradation display is realized.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DETAILED DESCRIPTION OF THE EMBODIMENTS

The present invention will be discussed hereinafter in detail in terms of the preferred embodiments of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

First Embodiment

Figure 1:
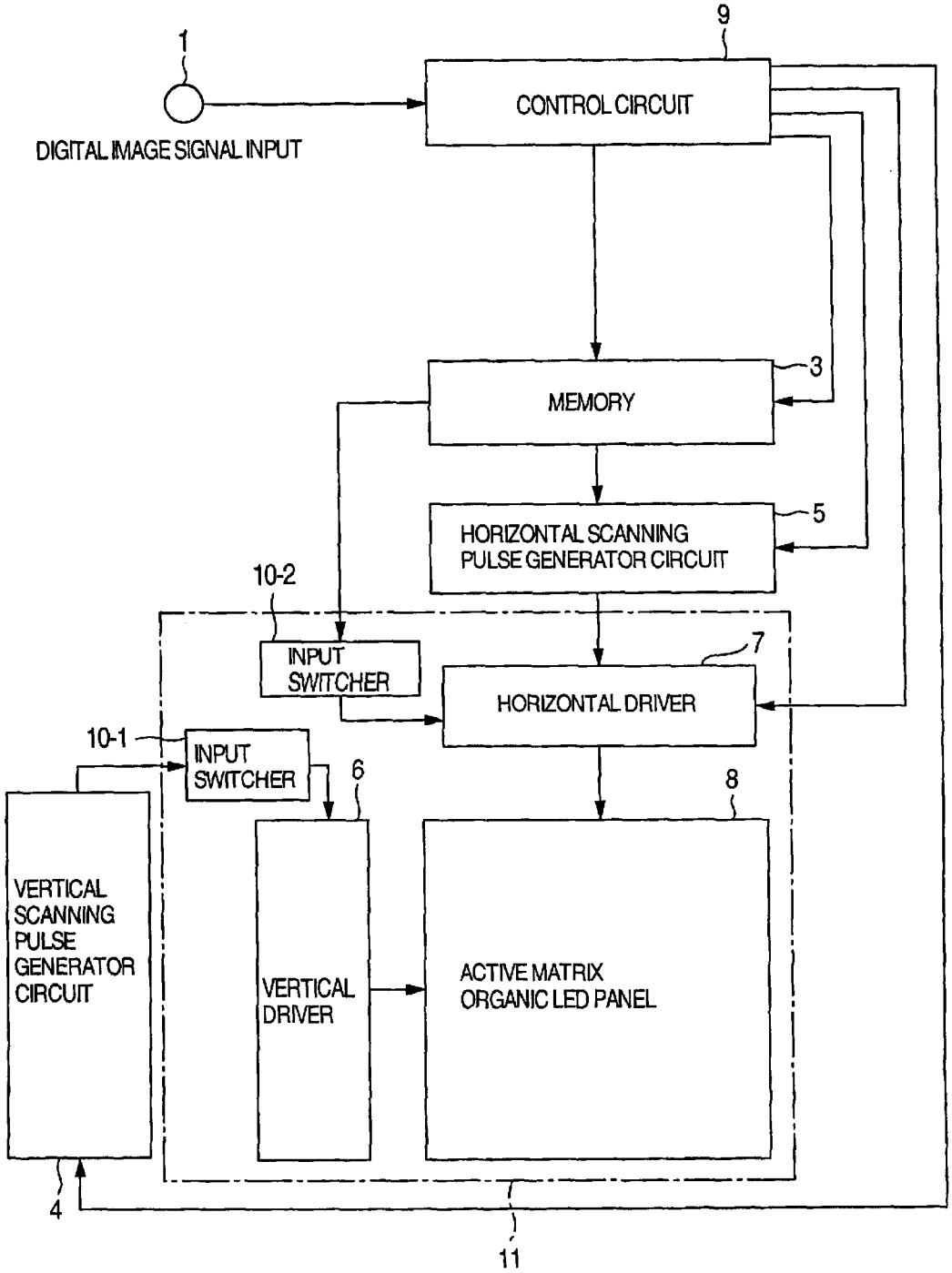
FIG. 1 is a block diagram of one embodiment of an image display apparatus according to the present invention.

FIG. 1 is a block diagram of a major part of the first embodiment of an image display apparatus according to the present invention. The image display apparatus is constructed with an image signal input terminal 1, an A/D converter 2, a memory 3, a vertical scanning pulse generator circuit 4, a horizontal scanning pulse generator circuit 5, a vertical driver 6, a horizontal driver 7, an active matrix organic LED panel 8, a control circuit 9 and an input switchers 10-1 and 10-2. The vertical driver 6 having the input switcher 10-1 in an input portion thereof, the horizontal driver 7 having the input switcher 10-2 in an input portion thereof and the active matrix organic LED panel 8 as combined are generally referred to as a display portion 11. The display portion 11 has a construction of TFT drive with the same substrate.

Operation of each component shown in a form of block will be discussed hereinafter. The control circuit 9 generates various control signals in synchronism with input image signal for supplying to each circuit. The vertical scanning pulse generator circuit 4 generates a vertical scanning pulse for vertical scan of an organic LED panel 8 on the basis of a control signal for scanning the organic LED panel 8 by inputting the vertical scanning pulse to the vertical driver 6 via the input switcher 10-1. The horizontal scanning pulse generator circuit 5 takes image signal in a memory 3 via the input switcher 10-2 per each bit in synchronism with the control signal and generates writing pulse for display pixels aligned in horizontal direction. This writing pulse is applied to the organic LED panel 8 via the horizontal driver 7 in exact timing with vertical scan.

In the display portion 11, for the pixels in a row selected by the vertical driver 6, a predetermined binary voltage depending upon each bit of digital data obtained through A/D conversion of the image signal is output from the horizontal driver 7. Thus, the predetermined voltage depending upon the digital data is written in each pixel. The active matrix organic LED panel in the display portion has a display region of horizontal 320 pixels×vertical 240 pixels.

Figure 2A:
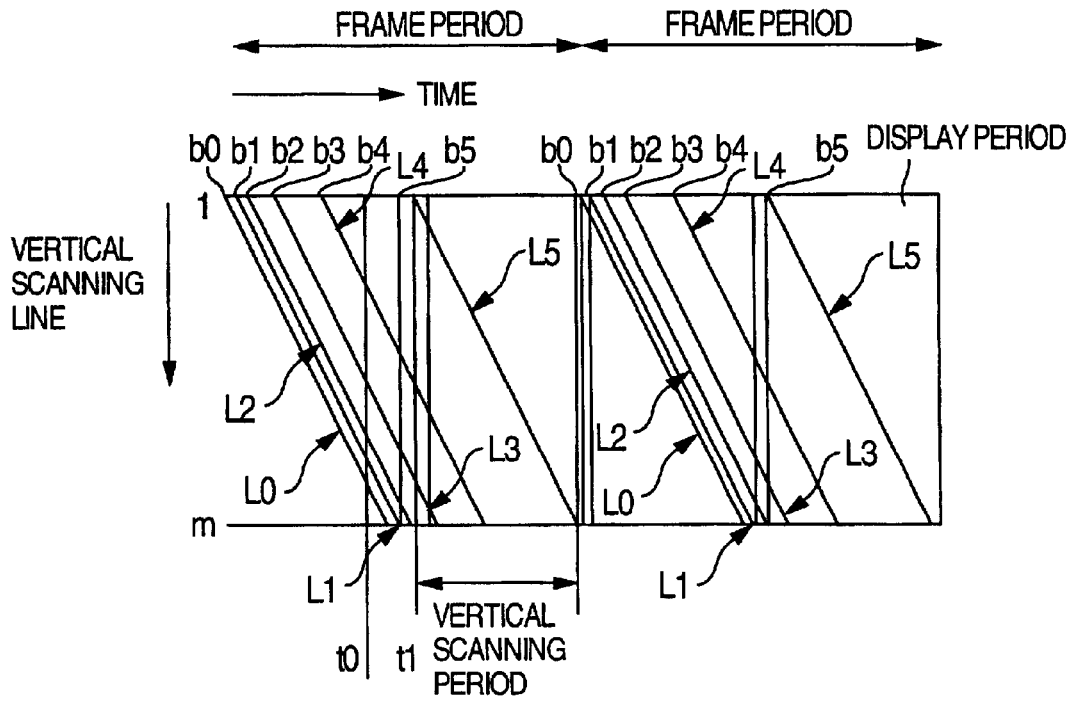
FIGS. 2A and 2B are explanatory illustration for explaining a drive diagram of the first embodiment.
Figure 2B:
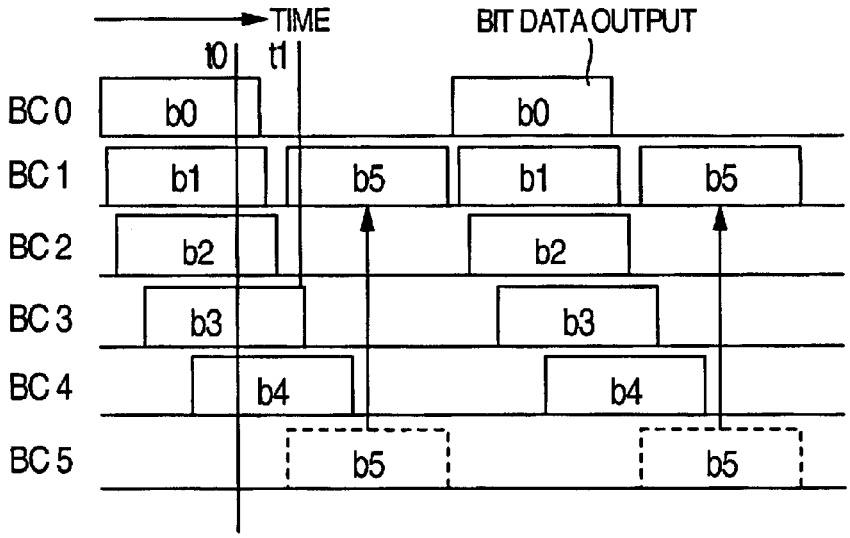

For gradation display as driven in a manner set forth above, multiplexed vertical scan may be performed as shown in FIGS. 2A and 2B. FIG. 2A shows the case where the image signal is 6-bit digital data. Data of respective bits from the least significant bit (LSB) to the most significant bit (MSB) are b0, b1, b2, b3, b4, b5. At this time, respective bits are scanned with shifting the phase along solid lines L0, L1, L2, L3, L4, L5 in time division manner. Here, by setting the vertical scanning period of each bit to be less than or equal to half of a frame period, the scanning period of b5 as MSB does not overlap with the scanning period of b0 or b1 at all.

FIG. 2B shows a manner of outputting of data per each bit to the panel on the same time axis as that of FIG. 2A. Assuming that a processing circuit is provided per each bit for multiplexed vertical scan, periods in which the processing circuit BCn of each bit outputs data for display, are shown by frames b0 to b5 with respect to BC0 to BC5. When the vertical scanning period is short, no problem will be encountered even when data of b5 output from the processing circuit BC5 may be output from the processing circuit BC1 which does not output data in the same period, as shown. Accordingly, for example, by employing the same output circuit for outputting data of b5 and b1, since luminescence period of the organic LED at each pixel is controlled according to the digital data, display of sixty-four gradation levels becomes possible in case of 6-bits.

Figure 3:
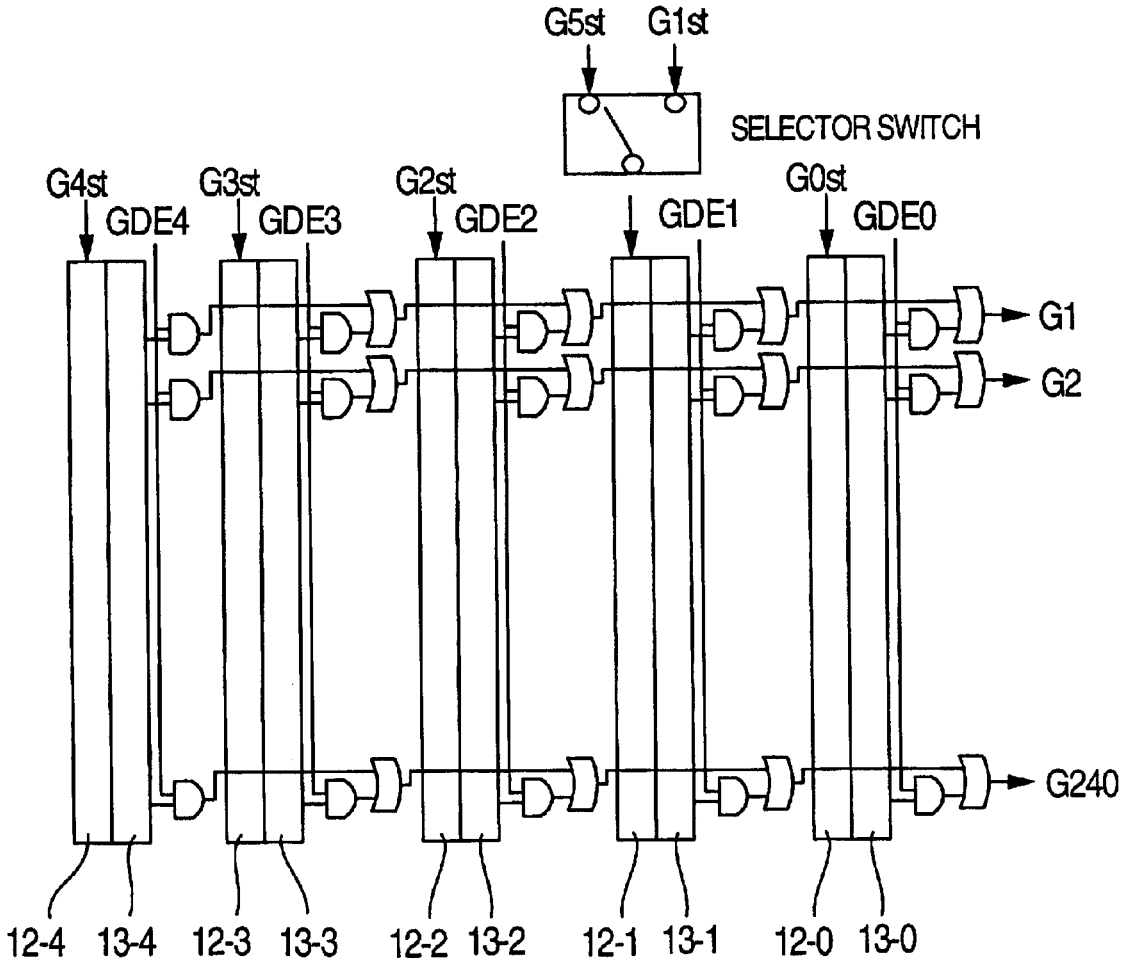
FIG. 3 is a constructional illustration of the first embodiment of a vertical driver.

FIG. 3 shows a construction of the vertical driver. In the shown embodiment, by summing the signals for vertical scan control per bit, common output circuit is used by the bit data b5 and b1. Here, five series of shift registers 12-0, 12-1, 12-2, 12-3, 12-4, number of which is smaller than number of data bits, start shifting operation by respective start pulses G0st, G2st, G3st, G4st and G5st or G1st switched by the selection switch. The outputs of the shift registers are input to logical operation circuits 13-0, 13-1, 13-2, 13-3, 13-4 for summing of products of the outputs of the logic operation circuits and tone control signals GDE0, GDE1, GDE2, GDE3, GDE4 per bit. When the final output becomes HIGH level, a signal Vgh turning ON TFT and Tsw connected to vertical scanning lines G1, G2, . . . , G240 is applied.

Figure 4A:
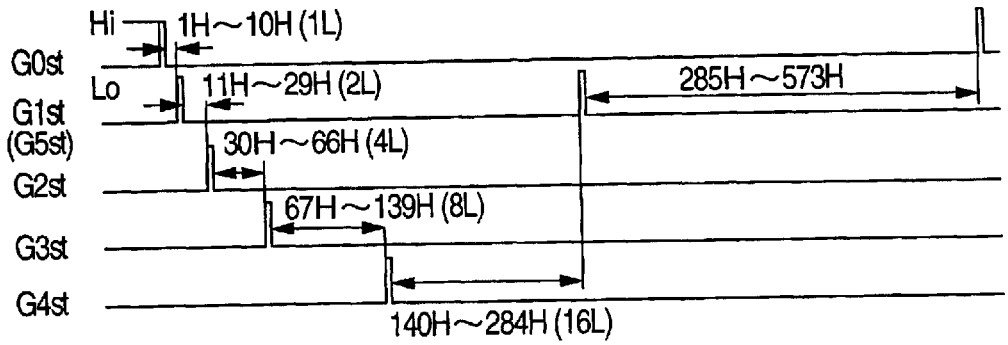
FIGS. 4A, 4B and 4C are control waveforms of the first embodiment of the vertical driver.
Figure 4B:
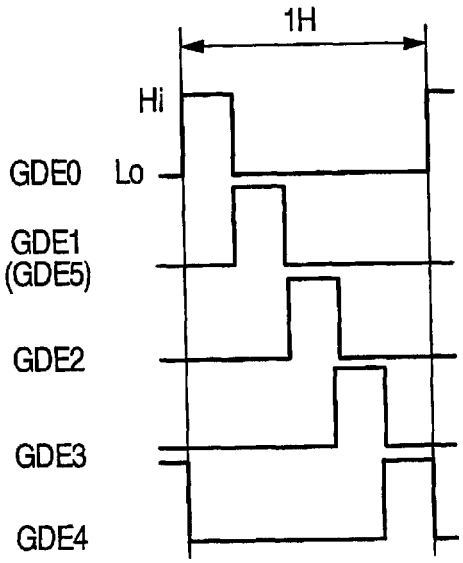
Figure 4C:
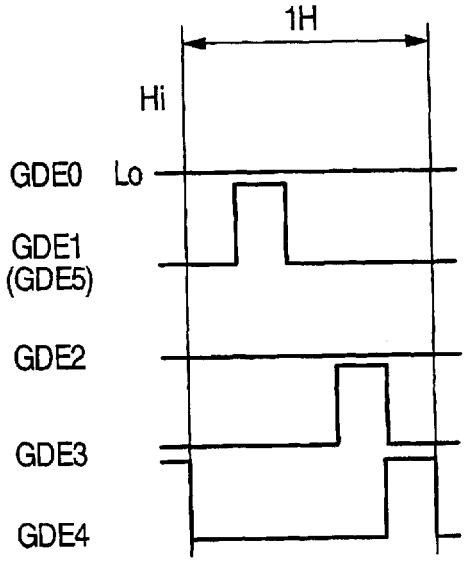

FIGS. 4A, 4B and 4C show waveforms for control operation to be applied to vertical driver. As shown in FIG. 4A, at a time t=0, the start pulse G0st becomes ON for 1H period (1H is horizontal scanning period). Subsequently, at luminous period 1L of b0 (1L is a fraction of one frame period divided by display gradation level number: about 1/63 frame period in case of 6 bits, and integer multiple of 1H, in the shown case 1L is assumed to be 9H. At this time, the frame period is 63L+6H=573H), the start pulse G1st is turned ON at a time t=10H. Thereafter, during a period 2L=18H, the start pulse G2st is turned ON at a time t=29H, during a period 4L=36H, the start pulse G3st is turned ON at a time t=66H, during a period 8L=72H, the start pulse G4st is turned ON at a time t=139H, and during a period 16L=144H, the start pulse G5st is turned ON at a time t=284H. Periods between the start pulses are used for display, respectively.

As shown in FIG. 4B, GDE0, GDE1, GDE2, GDE3, GDE4 are pulse trains defined by equally dividing 1H period in shown sequential order. As the time t=t0 in FIGS. 2A and 2B, when data outputs are present in the circuits of all bits of BC0 to BC4, the pulse train as shown in FIG. 4B may be applied to the vertical driver, and when data is output from BC1, BC3 and BC4 as the time t=t1 in FIGS. 2A and 2B, the pulse train shown in FIG. 4C may be applied to the vertical driver.

When b1 and b5 are switched by the bit processing circuit BC1, to the first scanning line G1, the voltage Vgh for turning ON TFT is applied for a period about H/5 at a time 0, a time 10+(1/5)H, a time 29+(2/5)H, a time 66+(3/5)H, a time 139+(4/5)H and a time 284+(1/5)H. Assuming that the vertical scanning period is 240H which is less than or equal to ½ of the frame period, since intervals from G1st to G5st and from G5st to G1st are 274H and 298H respectively, overlapping in time will not be caused even when the shift register 12-1 and the logical operation circuit 13-1 are used in common. Also, since 1H is divided by bit number, it will never be caused to turn ON TFTs connected to a plurality of vertical scanning lines at the same time to admix the signals.

The vertical driver of the construction set forth above can easily increase display bit number without increasing wiring in vertical direction by increasing the shift register, the logic operation circuit and the product summing portion per combination thereof. On the other hand, by processing a plurality of bits by the same output circuits by switching the inputs as in the construction set forth above, increasing of the circuit scale can be restricted to be smaller in comparison with increasing of bit number of the digital data. Furthermore, total of luminous periods substantially corresponds to one frame period to improve efficiency of luminescence.

Figure 5:
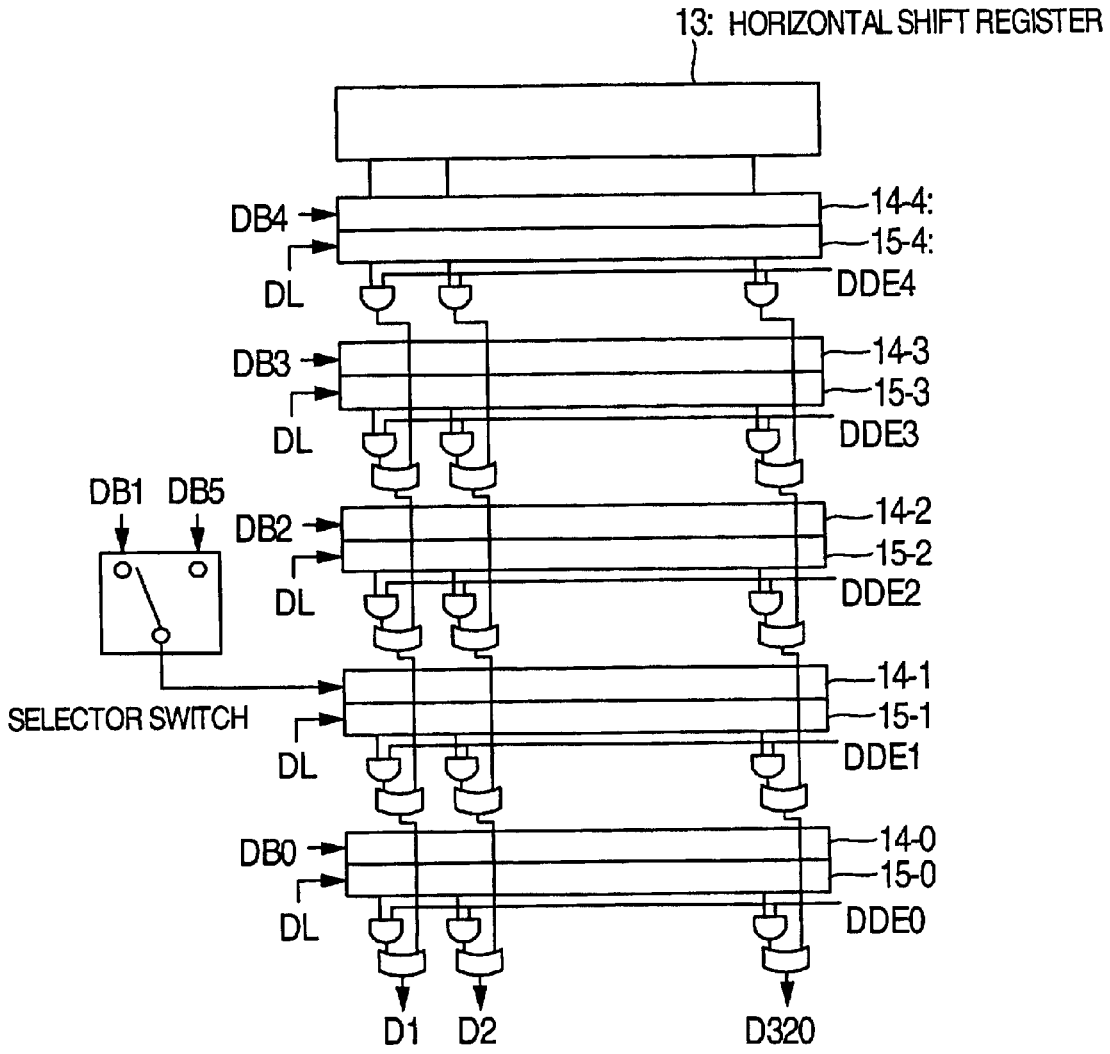
FIG. 5 is a constructional illustration of the first embodiment of a horizontal driver.

FIG. 5 shows a construction of the horizontal driver. The horizontal driver 7 is constructed with one series of shift register and latch circuits 14-0, 14-1, 14-2, 14-3, 14-4 provided per each bit for sequentially summing the products of outputs of the latch circuits and data output control signals DDE0, DDE1, DDE2, DDE3, DDE4. As input for the latch circuit 14-1, data buses DB1 and DB5 are selectively used by providing a selector switch.

Figure 6A:
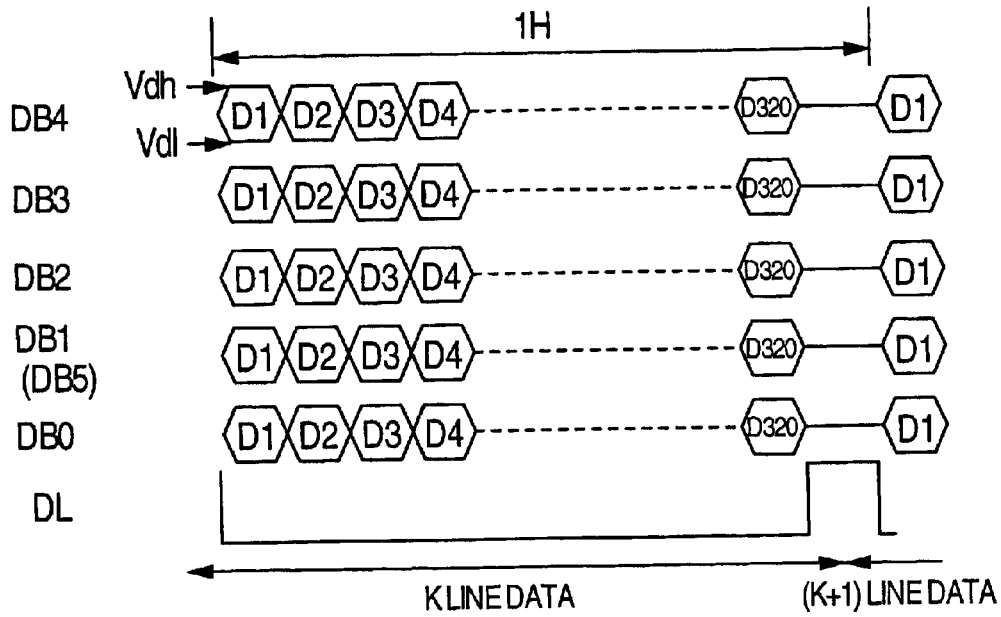
FIGS. 6A, 6B and 6C are control waveforms of the first embodiment of the horizontal driver.
Figure 6B:
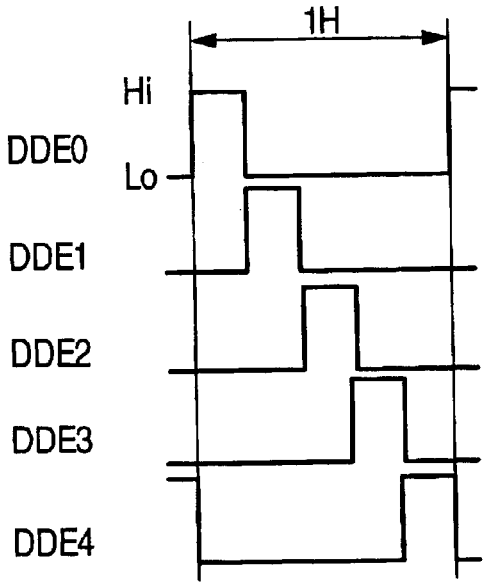
Figure 6C:
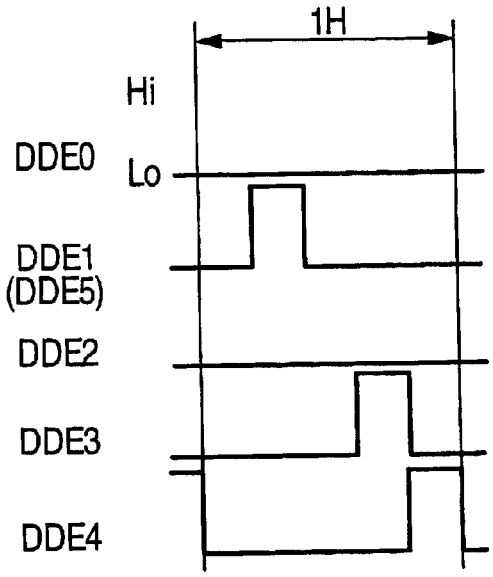

Basic drive wave forms are shown in FIGS. 6A, 6B and 6C. As shown in FIG. 6A, to data buses DB0, DB1, DB2, DB3, DB4, image data stored in the frame memory is taken out to be output 5 bits of image data as maximum, and are input to respective latch circuits 15. Data input in this manner is repeated for times corresponding to number of pixels in horizontal direction, i.e. 320 in the shown embodiment, in synchronism with shift register output within 1H period. Subsequently, input data is stored in a line memory in the latch circuit on the basis of data latch signal DL. In the next 1H period, respective output control signals DDE0, DDE1, DDE2, DDE3, DDE4 are respectively turned ON in sequential order to apply high level voltage Vdh and low level voltage Vd1 on data line depending upon digital data. Timing of application of voltage on data line is matched with the timing of the vertical scan as set forth above.

Accordingly, as the time t=t1 in FIGS. 2A and 2B, when outputs are present only in 3 bits out of 5 bits, a pulse train as shown in FIG. 6C is applied similarly to FIG. 4C. By this, application of Vdh by data of the least significant bit is maintained for 1L =9H, and application of Vdh by data of the most significant bit is maintained for 32L=288H. A time expressed at t=t0 in FIGS. 2A and 2B, all bit outputs are present as shown in FIG. 6B, whereas, at a time t=t1, only 3 bits out of 5 bits are present.

As set forth above, in the display portion 11, the current flowing through the organic LED is controlled to be binary value of ON/OFF. Namely, in switching transistor in the pixel, the gate signal Vgh is so related with data signals Vdh and Vd1 as to operate in non-saturated condition, and furthermore, in the driver transistor, the data signal Vdh is so related with an applied voltage Vdd to a current supply line of the organic LED as to operate in non-saturated condition. The stored capacity Cs restricts gate voltage fluctuation of the driver transistor when the switch transistor is in OFF condition so as not to cause variation of gradation display due to variation of current flowing through the organic LED.

It should be noted that the present invention should not be limited to the shown embodiment. Number of TFT in the pixel is not limited to two but can be more. While embodiment constructed the horizontal driver and the vertical driver with TFTs, the effect of the present invention will never be degraded as long as the connecting portion with the active matrix portion is TFT. For example, the shift register portion of the vertical driver may be constructed with an external integrated circuit.

On the other hand, in the foregoing, while discussion has been given in connection with the organic LED display, the display element is not limited to luminous element. The construction of the driver circuit is of course applicable for a display of other active matrix system, a display using liquid crystal to switch at high speed or field emission element (FED) or the like.

Upon performing multiplexed horizontal scan, when the vertical scanning period Tvsc is less than or equal to hold of the frame period Tfr, two bit data which do not overall data output period can be processed with a common output circuit. Therefore, circuits for one bit can be eliminated from both of the vertical drive circuit and the horizontal drive circuit.

As set forth above, when sequence circuit is eliminated from the vertical driver circuit and line latch circuit is eliminated from the horizontal drive circuit by processing two 1-bit data by common output circuit, a ratio to actually input data for the sequence circuits or the line latch circuits to use the circuit is defined as operation ratio Rmv, as expressed by the following expression (1).

$$Rmv=(Tvsc\times m)/(Tfr\times n) \quad (1)$$

wherein m: input bit number, n: number of bit processing circuit BC of the vertical driver or horizontal driver In the foregoing expression, when a ratio Rvs of Tvsc/Tfr is 40%, for example, the operation ratio is Rmv=Rvs×m/n=40×6/5=0.48 and thus is merely 48%. This is because the operation ratio of the circuit for four bits not processed by the common output circuit among the sequence circuit/line latch circuit is merely 40%.

Considering length of 1H period, without using the sequence circuit and the line latch circuit in common for a plurality of bits, and thus the vertical scanning period Tvsc is equal to the frame period Tfr, 1H=Tvsc/240=Tfr/600 in case of the display device constructed with 240 lines in vertical direction as in the first embodiment. Thus, selection period per one bit becomes 1H/6=Tfr/(6×240)=Tfr/1440.

On the other hand, when the sequence circuit and the line latch circuit are used in common for processing a plurality of bits as in the first embodiment for processing six bit data with four stages of circuits, if ratio Rvs of the vertical scanning period/frame period is 40%, for example, 1H period is expressed by 1H=Tvsc/240=0.4×Tfr/240=Tfr/600. Thus, the selection period per one bit becomes 1H/5=Tfr/(5×600)=Tfr/3000. In comparison with the case where the circuits are used in common with a plurality of bits, the selection period per one bit becomes (Tfr/1440)/Tfr/3000)=0.48 and thus becomes shorter at a rate of the rotation ratio Rmv.

Accordingly, while the first embodiment is successfully in reducing the circuit scale, it is required to drive at about double of speed. Since higher operation speed causes greater power consumption, it is desired to lower the operation speed as much as possible.

As set forth above, by further shortening the vertical scanning period, greater number of circuits may be eliminated. However, associating with shortening the vertical scanning period, 1H period also becomes shorter to shorten ON period of TFT to be a cause of degradation of image quality. In order to avoid this, it becomes necessary to set the vertical scanning period as long as possible with reducing circuit scale to improve operation ratio Rmv of the overall sequence circuits or line latch circuits.

Hereinafter, discussion will be given for procedure for improving the operation ratio Rmv. As set forth above, the operation ratio is expressed by Rmv=(vertical scanning period)×(m number of input bits)/{(frame period)×(number of stages n of sequence or line latch circuits)}. Therefore, it can be rewritten as the following expression (2) using a ratio Rvs=(vertical scanning period)/(frame period).

$$Rmv=Rvs\times m/n \quad (2)$$

From this, for making Rmv greater with respect to certain input bit number m, it has to make Rvs greater and to make number of stages n of the sequence or line latch circuits smaller. Such method will be discussed in the second embodiment.

Second Embodiment

In the operation condition as illustrated in FIGS. 2A and 2B, observing at a certain timing, period to operate the sequence circuit and the logic operation circuit of the vertical drive circuit or line data latch circuit of the horizontal drive circuit corresponding to each bit data is data use period as shown in FIG. 2B.

In the shown example, at the time shown by vertically extending line, five bit data are used. Therefore, at least five sequence circuits and the logic operation circuits of the vertical drive circuit and line data latch circuits of the horizontal drive circuits are required. Namely, in the display apparatus for multiple gradation display with m (>n) bit digital data, if number of the sequence circuits and their logic operation circuits of the vertical drive circuit is n, the minimum value of n is equal to the maximum number of the bit data input at the same timing in the frame period.

On the other hand, the maximum value of the vertical scanning period Tvsc can be defined as follow. When luminous periods t10, t11, . . . tlm of respective bits of the m bit image data are determined, for displaying such image data with n stages of sequence circuit 13 and the line latch circuit 15, it may be required the vertical scanning period Tvs of certain data is finished during a period from inputting of certain data to inputting of (n)th data. In the display system of the present invention, most of the frame period can be used as display period. Therefore, in the following discussion, the horizontal selection period 1H as the data writing period is ignored.

An elapsed period from inputting of the certain data to inputting of the (n)th data, is equal to a total of the luminous period assigned for respective bits from the certain data to (n+1)th data. If this value is always greater than Tvs, the image data can be displayed with n stages of circuits.

For example, it is assumed that the frame period Tfr=$2^{m-1}$L, that the luminous periods t10, t11, . . . , tlm per each bit of m bit image data is respectively tlx (x=1, 2, . . . , m) $2^{x-1}$L, that order of input is determined as DB0, DBm, . . . , DB2, DBm-1. . . , from permutation generated by rearranging luminous period tlx to match with order of input of data bit, all totals of arbitrary continuous n (<m) bits are derived to set the minimum value of the derived totals as Tvsmax, and then, the vertical scanning period Tvsc is determined to satisfy Tvsc≦Tvscmax to permit determination of the vertical scanning period Tvsc where the operation ratio Rmv becomes maximum with a construction of n stages of sequence circuits in the vehicle drive circuit and n stages of line latch circuits in the horizontal drive circuit smaller than number of data bit m. Thus, the image display apparatus having smaller circuit scale and smaller power consumption can be constructed.

Hereinafter, discussion will be given for a manner of determining order of input of the image data to achieve maximum rotation ratio Rmv of the drive circuit in the image display apparatus of the construction where the vertical drive circuit and the horizontal drive circuit are constructed with respectively three stages of sequence circuits and the line data latch circuits with respect to the 6-bit image data.

When the frame period is $Tfr=2^{6-1}L$ and luminous periods t10, t11, . . . , t16 of respective bits of the image data are determined by luminous period tlx (x=1, 2, . . . , 6)=$2^{n-1}$, for order of data input is 0, 1, 2, 3, 4, 5, 0, 1, 2, 3, 4, 5, . . . permutation of the luminous periods becomes 1L, 2L, 4L, 8L, 16L, 32L, 1L, 2L, 4L, 8L, 16L, 32L, . . . From this, respective sums of luminous periods per 3 bits calculated in sequential order will be as follow.

Since the sums of the luminous periods are 7L, 14L, 28L, 56L, 49L, 35L, 7L, 14L, 28L, 56L, 49L, 35L, . . . , and thus Tvsmax=7L, the operation ratio Rmv=7L/63L×6/3=0.22. Therefore, the operation ratio becomes 22% at the maximum.

For improving operation rate, the minimum value of sums of the luminous periods per 3 bits is required to be made greater. For this purpose, re-ordering has to be made avoid sequential arrangement of bits having short luminous periods. Therefore, the bits having short luminous periods and the bits having long luminous periods are to be arranged in alternate order to establish order of data input 0, 5, 1, 3, 2, 4, 0, 5, 1, 3, 2, 4, . . . , and then luminous periods (tbx) per bit become 1L, 32L, 2L, 8L, 4L, 16L, 1L, 32L, 2L, 8L, 4L, 16L, . . .

Then, since sums of luminous periods per 3 bits will be 35L, 42L, 14L, 28L, 21L, 49L, 35L, 42L, . . . , the minimum value of the sums Tvscmax 14L to achieve the operation ratio 44% at the maximum. Therefore, in comparison with the case where the order of data input in the first embodiment is used, the operation ratio is improved to be three times.

Third Embodiment

As set forth above, by re-ordering data in the manner shown in the second embodiment, in case of 6-bit image data, the operation ratio is improved to be double in comparison with the case where order of data input of the first embodiment is used. However, operation ratio is still less than or equal to 50%. Procedure to further improve operation ratio will be discussed hereinafter.

As discussed in the second embodiment, for realizing the vertical driver and the horizontal driver with n stages of bit processing circuits for processing the m bits image data, the vertical scanning period Tvsc has to be less than or equal to the sums of the luminous periods of sequential n bits.

Here, when the sum of the luminous periods of sequential n bits is tlbn, tlbn means a period from inputting of certain data to the sequence circuit of the vertical drive circuit or the line data latch circuit of the horizontal drive circuit to input of the next data to the same sequence circuit of the vertical drive circuit or the line data latch circuit of the horizontal drive circuit. Accordingly, a period derived by subtracting the vertical scanning period from tlbn is the period where data is not input to the sequence circuit of the vertical drive circuit or the line data latch circuit of the horizontal drive circuit. For this reason, during the period substracted the vertical scanning period Tvsc from tlbn, data is not inputted to the sequence circuit or line data latch circuit. Namely, in this period, circuit is not used. Accordingly, when the difference between the maximum value tlbnmax of tlbn and Tvsc can be made small, operation ratio of the circuit can be improved. Since the minimum value tlbnmin of Tvsc=tlbn, it means nothing but to make tlbnmin/tlbnmax large.

In case of the second embodiment, the difference between the minimum value tlbnmin=Tvscmax=14L of tlbn and tlbnmax=49L is greater than or equal to 3 times. The cause of this is that at bit 5 where the luminous period is maximum, the luminous period tb5=32L greater than tlbnmin. Among tlbn, those containing bit 5 inherently greater than tlbnmin to make non-use period of the sequence circuit or the line data latch circuit long to lower operation ratio Rmv of the circuit. As a solution for this, is may be a possible approach to divide the luminous period of the bit where the luminous period becomes the longest, exceeds tlbnmin=Tvscmax into two for dividedly inputting.

An embodiment for realizing processing of 6 bit data with three sequence circuits and its logic operation circuits of the vertical drive circuit or three line data latch circuits of the horizontal drive circuit, will be discussed with reference to FIGS. 7A, 7B, 8 and 9.

Figure 7A:
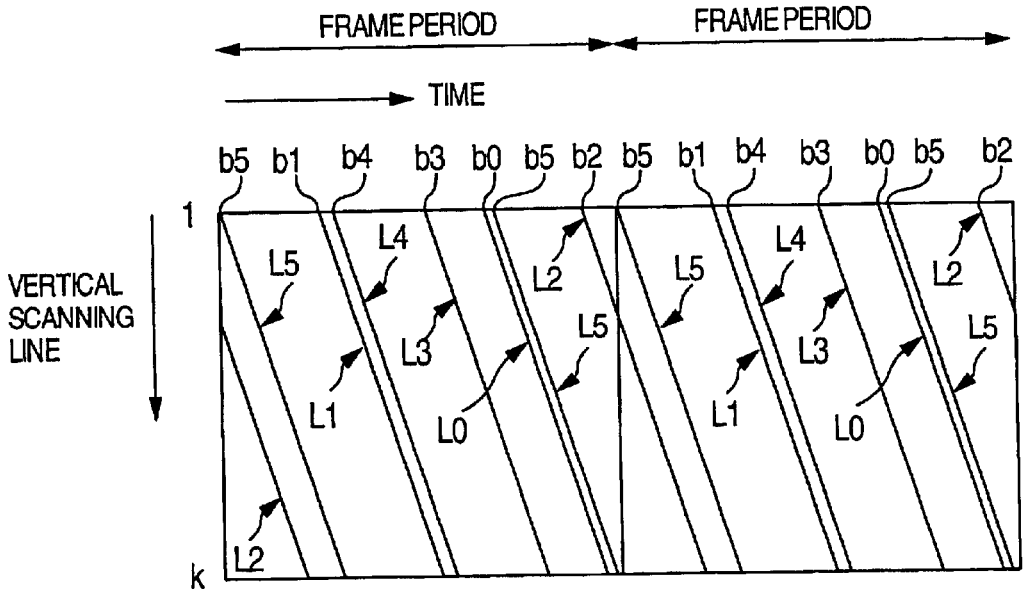
FIGS. 7A and 7B are explanatory illustration showing a drive diagram of the third embodiment for 6-bit gradation display.
Figure 7B:
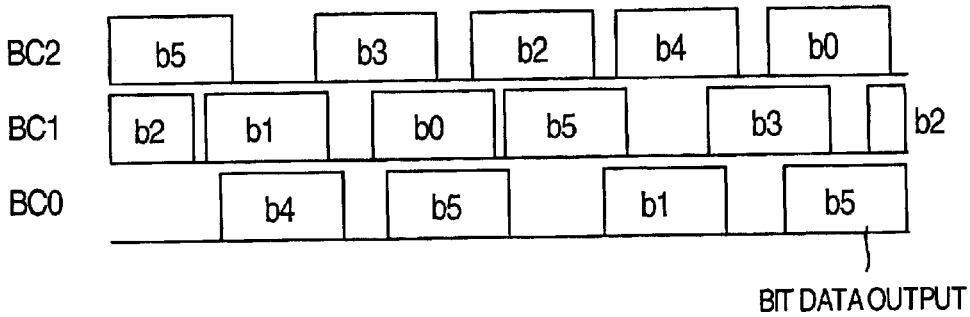

FIGS. 7A and 7B show manner of multiplexed vertical scan when the maximum weight bit among 6 bit data is divided into two to make the vertical scanning period longer and operation ratio of the circuit higher, and status of data output from each bit processing circuit.

Figure 8:
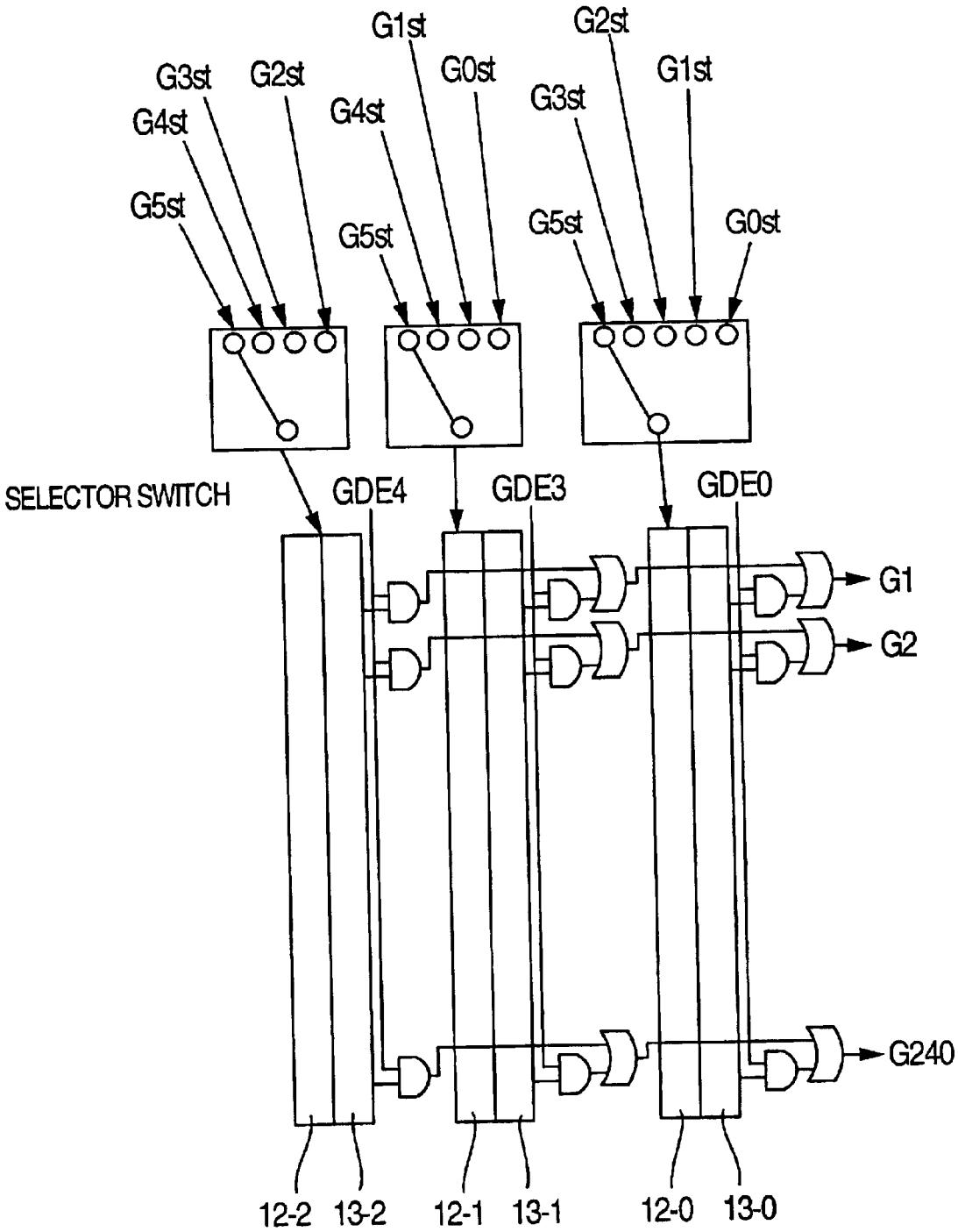
FIG. 8 is a constructional illustration the vertical driver of the third embodiment for 6-bit gradation display.
Figure 9:
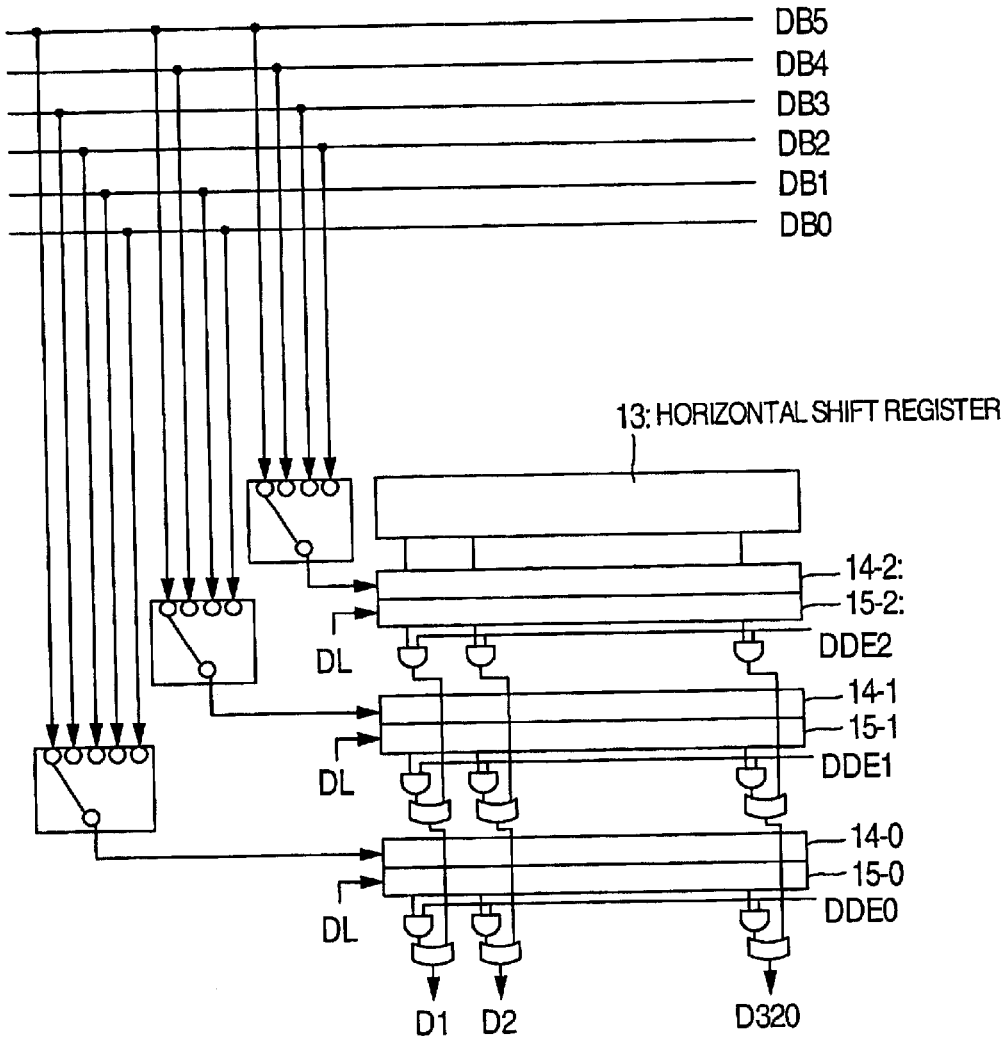
FIG. 9 is a constructional illustration the horizontal driver of the third embodiment for 6-bit gradation display.

FIG. 8 shows a structural example of the vertical drive circuit for realizing the operation shown in FIGS. 7A and 7B. FIG. 9 shows a structural example of the horizontal drive circuit for realizing the operation shown in FIGS. 7A and 7B. As shown in FIGS. 7A and 7B, when b5 where the display period is the largest in the frame period, is divided into two, the operation ratio Rmv=77% much greater than 50%.

In the shown embodiment, for 6 bit digital data, number of the sequence circuits of the vertical drive circuit and the line data latch circuits of the horizontal drive circuit cant be three as half as required. Thus circuit scale can be significantly reduced to significantly lower the power consumption. Since 6 bit gradation display becomes possible, satisfactorily high quality display for image display apparatus for PC or the like can be provided.

On the other hand, as a method for dividing the luminous period of the bit having the longest luminous period, 32L is divided into two luminous period of 16L. Divided two luminous periods are not necessarily equal length, and the present invention should not be limited to division into equal luminous periods. In the foregoing example, it is of course possible to divide the luminous period into two periods of 17L and 15L. In this case, the operation ratio Rms becomes 81%.

Fourth Embodiment

Next, using 8 bit data, an embodiment where the operation ratio becomes the highest will be discussed. Applying the method of the third embodiment, an embodiment realizing process of 8 bit data with three stages of processing circuits in the vertical drive circuit and the horizontal driver circuit is shown in FIGS. 10A, 10B, 11 and 12.

Figure 10A:
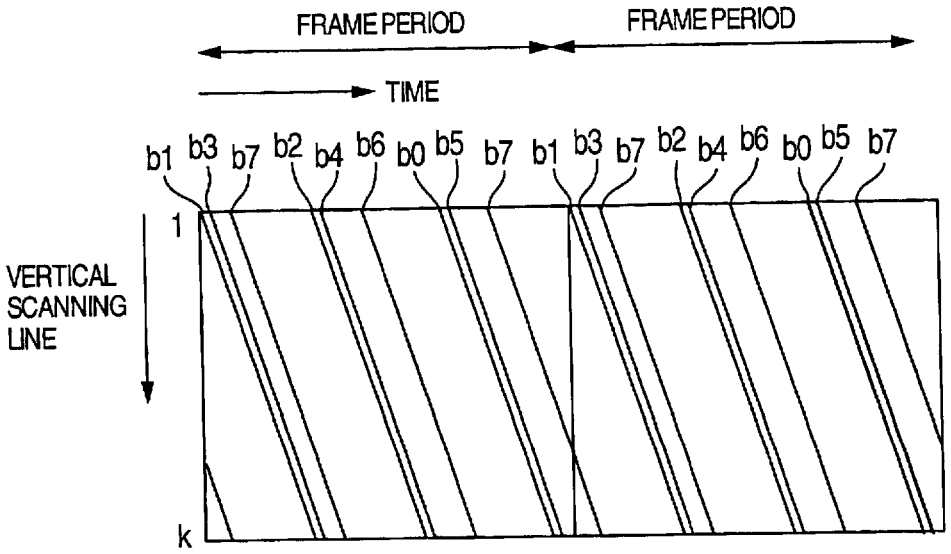
FIGS. 10A and 10B are explanatory illustration showing a drive diagram of the fourth embodiment for 8-bit gradation display.
Figure 10B:
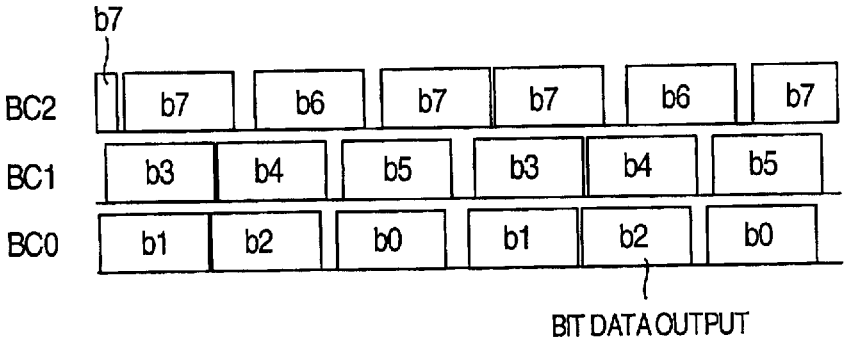
Figure 11:
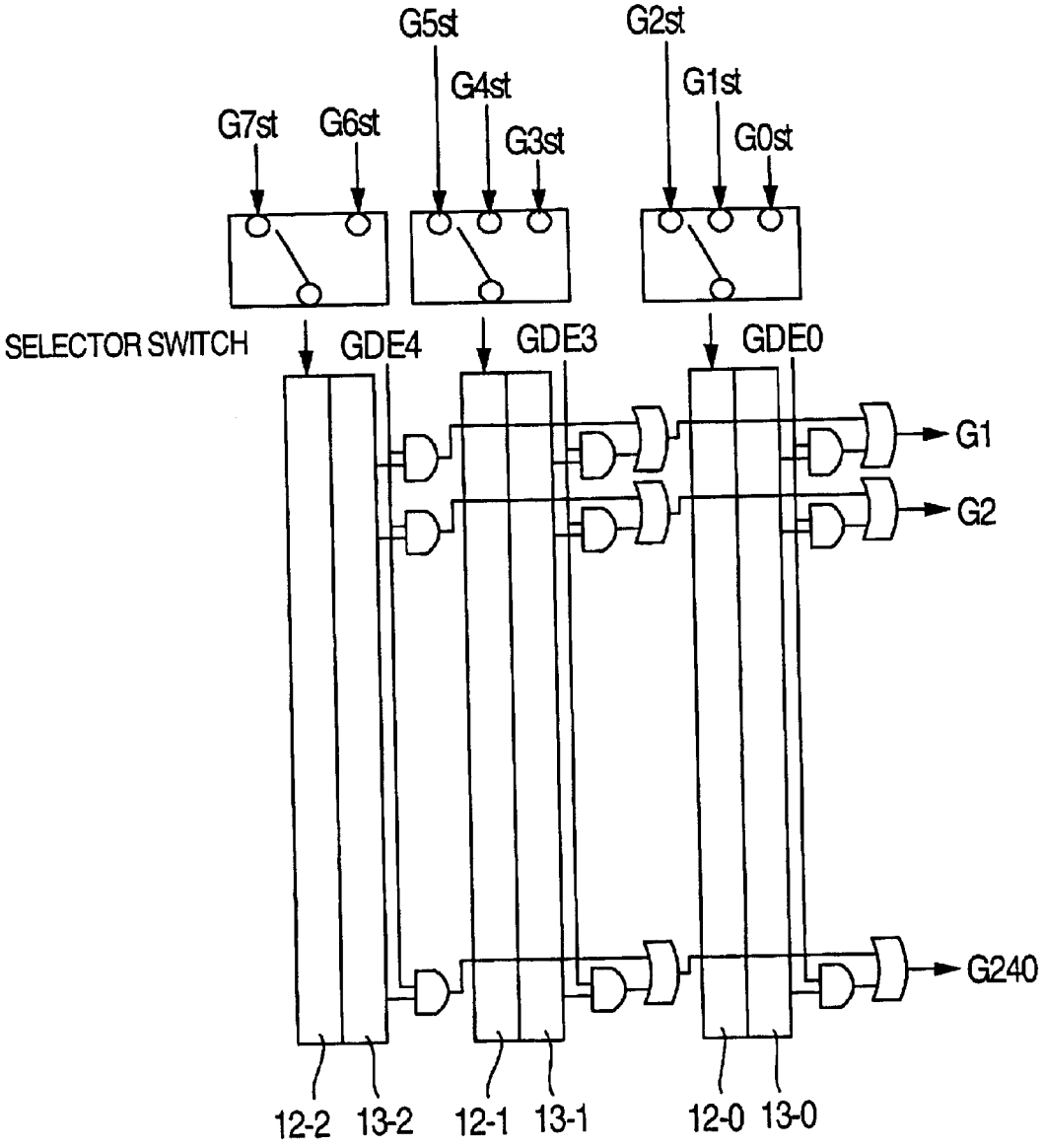
FIG. 11 is a constructional illustration the vertical driver of the fourth embodiment for 8-bit gradation display.
Figure 12:
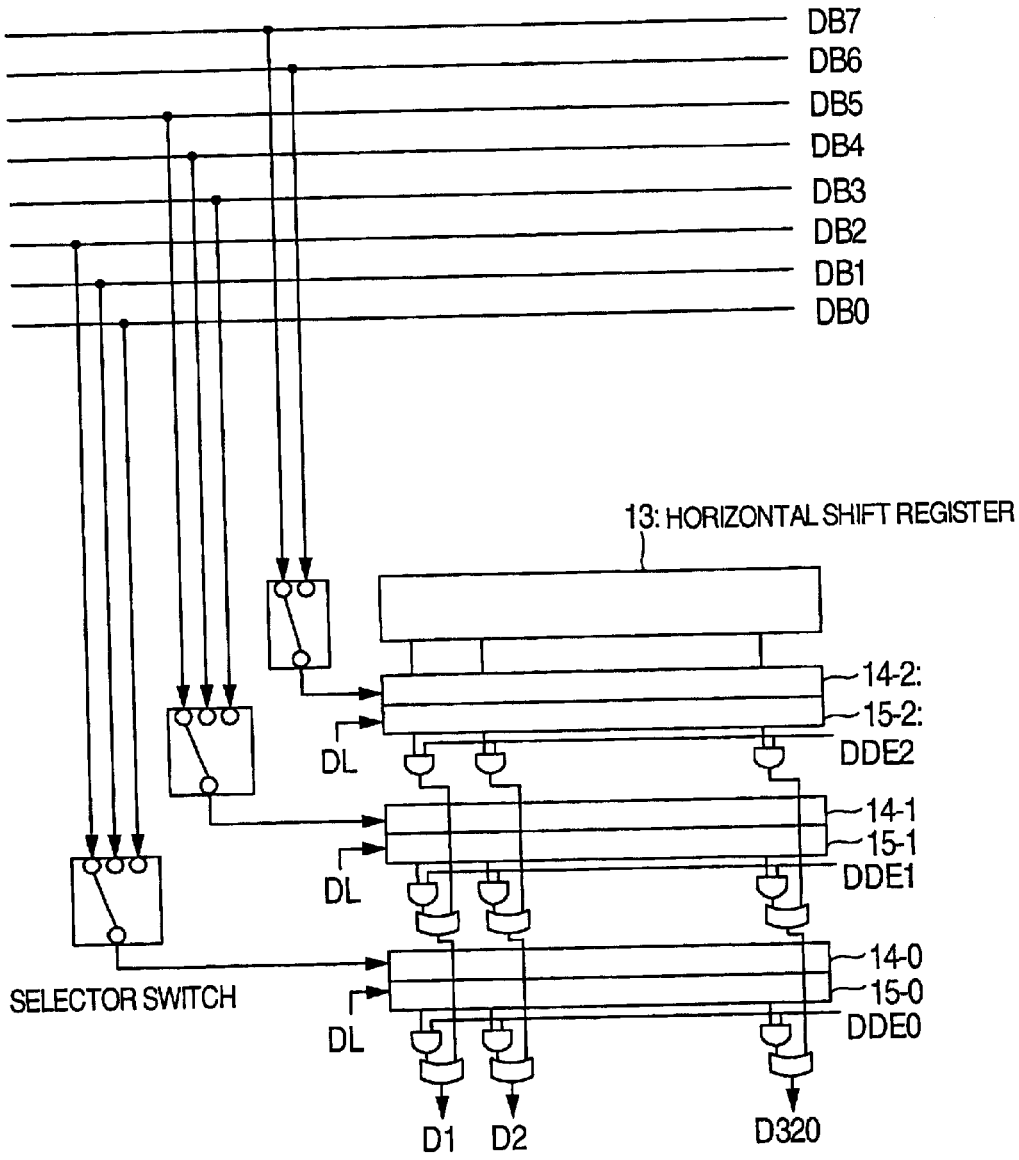
FIG. 12 is a constructional illustration the horizontal driver of the fourth embodiment for 8-bit gradation display.

FIGS. 10A and 10B show a manner of multiplexed vertical scan when the maximum weight bit among 8 bit data is divided into two to make the vertical scanning period longer and operation ratio of the circuit higher, and status of data output from each bit processing circuit. On the other hand, FIG. 11 shows a construction of the vertical drive circuit for realizing the operation shown in FIGS. 10A and 10B, and FIG. 12 shows a construction of the horizontal drive circuit.

In the shown embodiment, while the circuit scale is the same as the image display apparatus for 6 bits, further high quality 8 bit display can be performed to further reduce circuit scale and lower power consumption. On the other hand, the construction of the input switching portion is further simplified than the case of 6 bit.

Fifth Embodiment

Next, using 10 bit data, an embodiment where the operation ratio becomes the highest will be discussed. Applying the method of the third embodiment, an embodiment realizing process of 10 bit data with four stages of processing circuits in the vertical drive circuit and the horizontal driver circuit is shown in FIGS. 13A, 13B, 14 and 15.

Figure 13A:
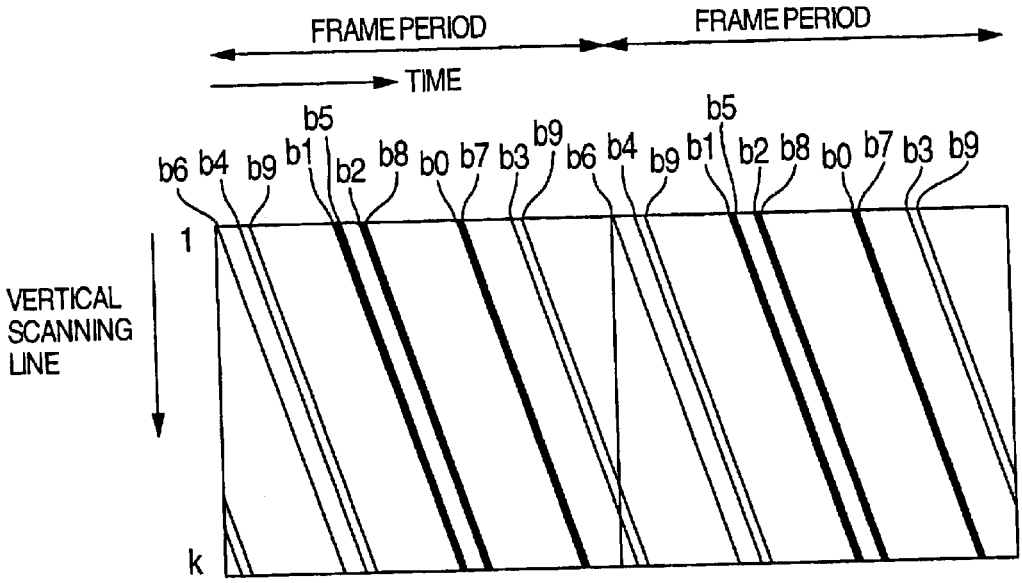
FIGS. 13A and 13B are explanatory illustration showing a drive diagram of the fifth embodiment for 10-bit gradation display.
Figure 13B:
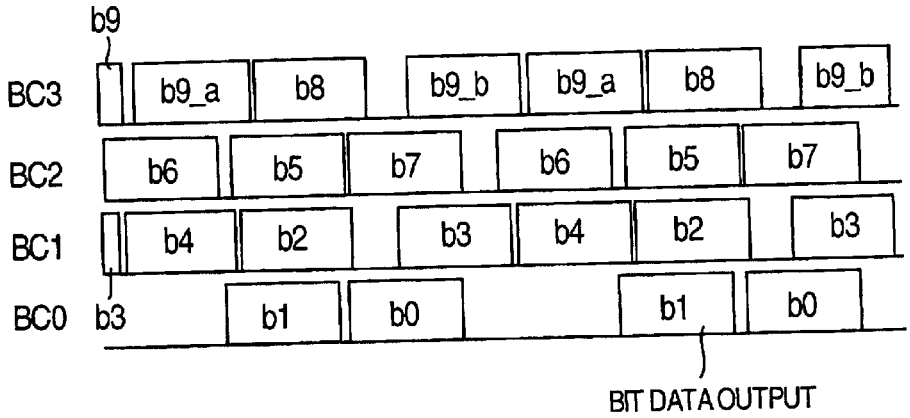
Figure 14:
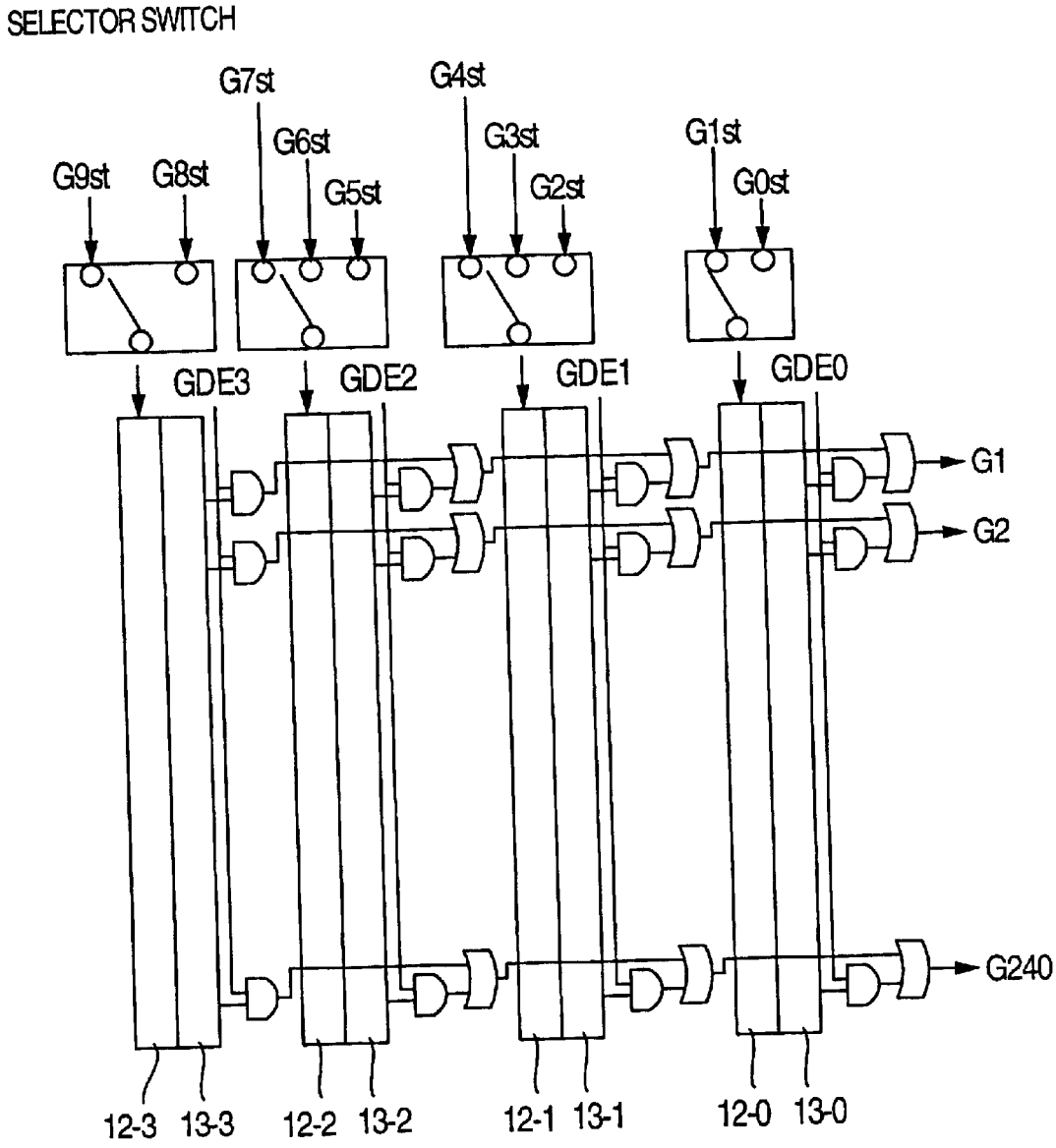
FIG. 14 is a constructional illustration the vertical driver of the fifth embodiment for 10-bit gradation display.
Figure 15:
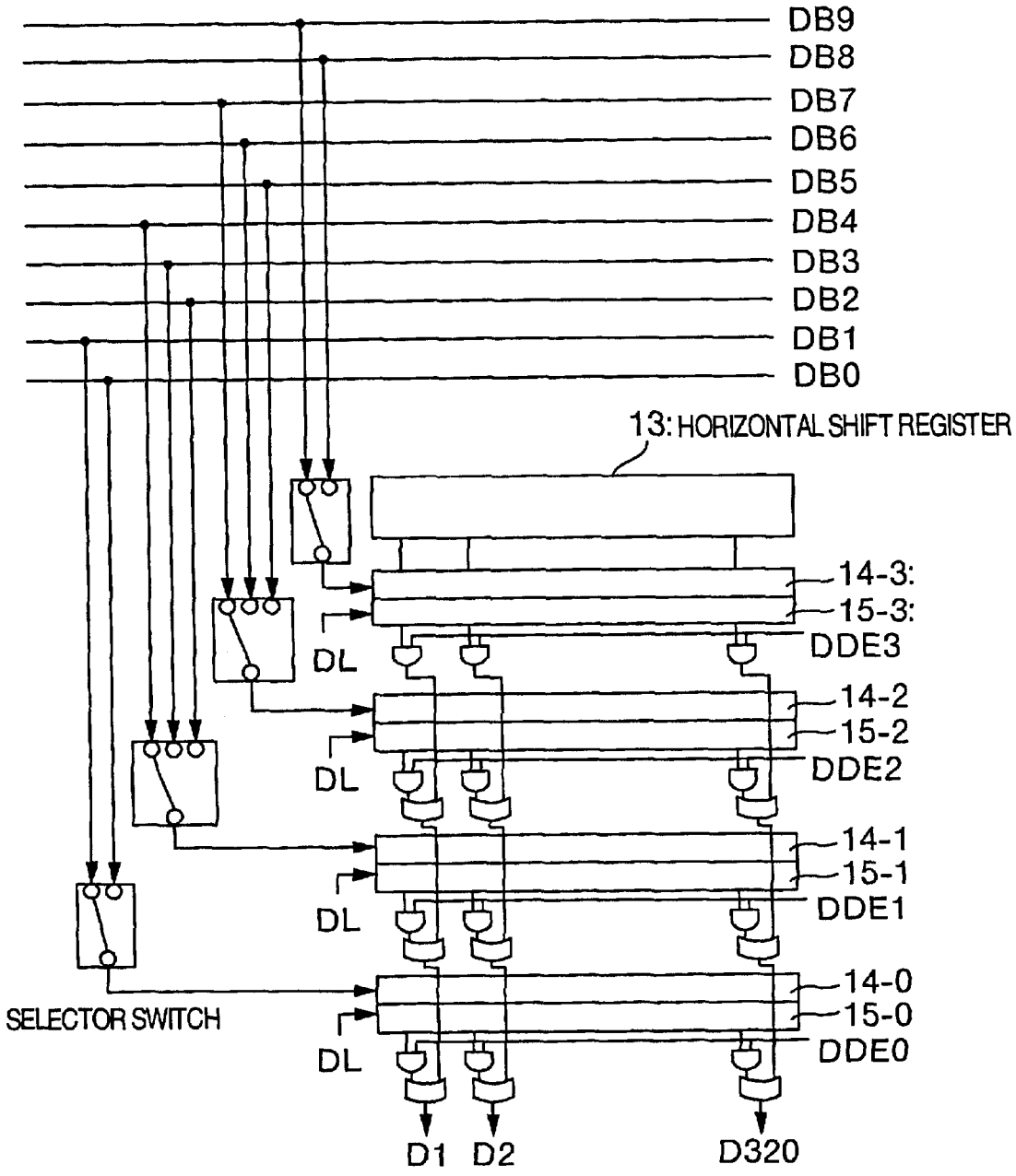
FIG. 15 is a constructional illustration the horizontal driver of the sixth embodiment for 10-bit gradation display.

FIGS. 13A and 13B show a manner of multiplexed vertical scan when the maximum weight bit (b9 in the shown case) among 10 bit data is divided into two to make the vertical scanning period longer and operation ratio of the circuit higher, and status of data output from each bit processing circuit. On the other hand, FIG. 14 shows a construction of the vertical drive circuit for realizing the operation shown in FIGS. 13A and 13B, and FIG. 15 shows a construction of the horizontal drive circuit for realizing the operation shown in FIGS. 13A and 13B. When the maximum display period b9 in the frame period is divided into display periods b9_a and b9_b, the operation ratio Rmv =85% can be achieved.

Sixth Embodiment

In this embodiment, sub-frame constantly becomes non-display is provided in the frame period for improving image quality. An embodiment for realizing process of 10 bit data with respectively four stages of bit processing circuits in the vertical drive circuit and the horizontal drive circuit by the driving method similar to the above, is illustrated in FIGS. 16A, 16B, 17, 18, 19A and 19B.

Figure 16A:
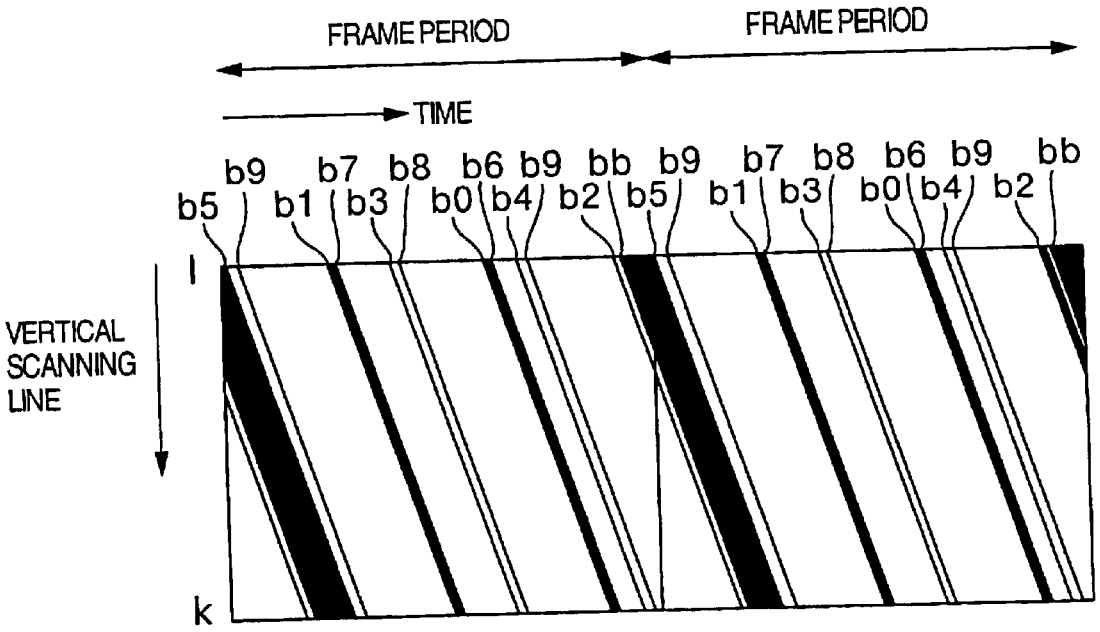
FIGS. 16A and 16B are explanatory illustration showing a drive diagram of the seventh embodiment for 10-bit gradation display including non-display period in a frame period.
Figure 16B:
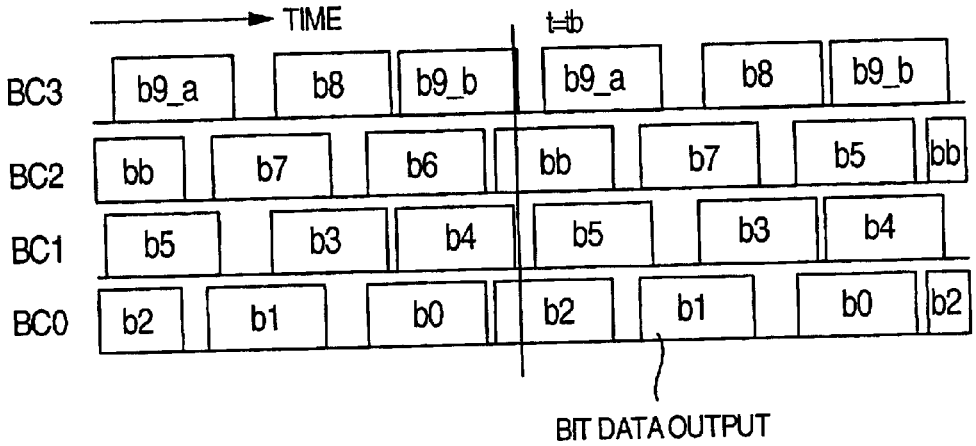
Figure 17:
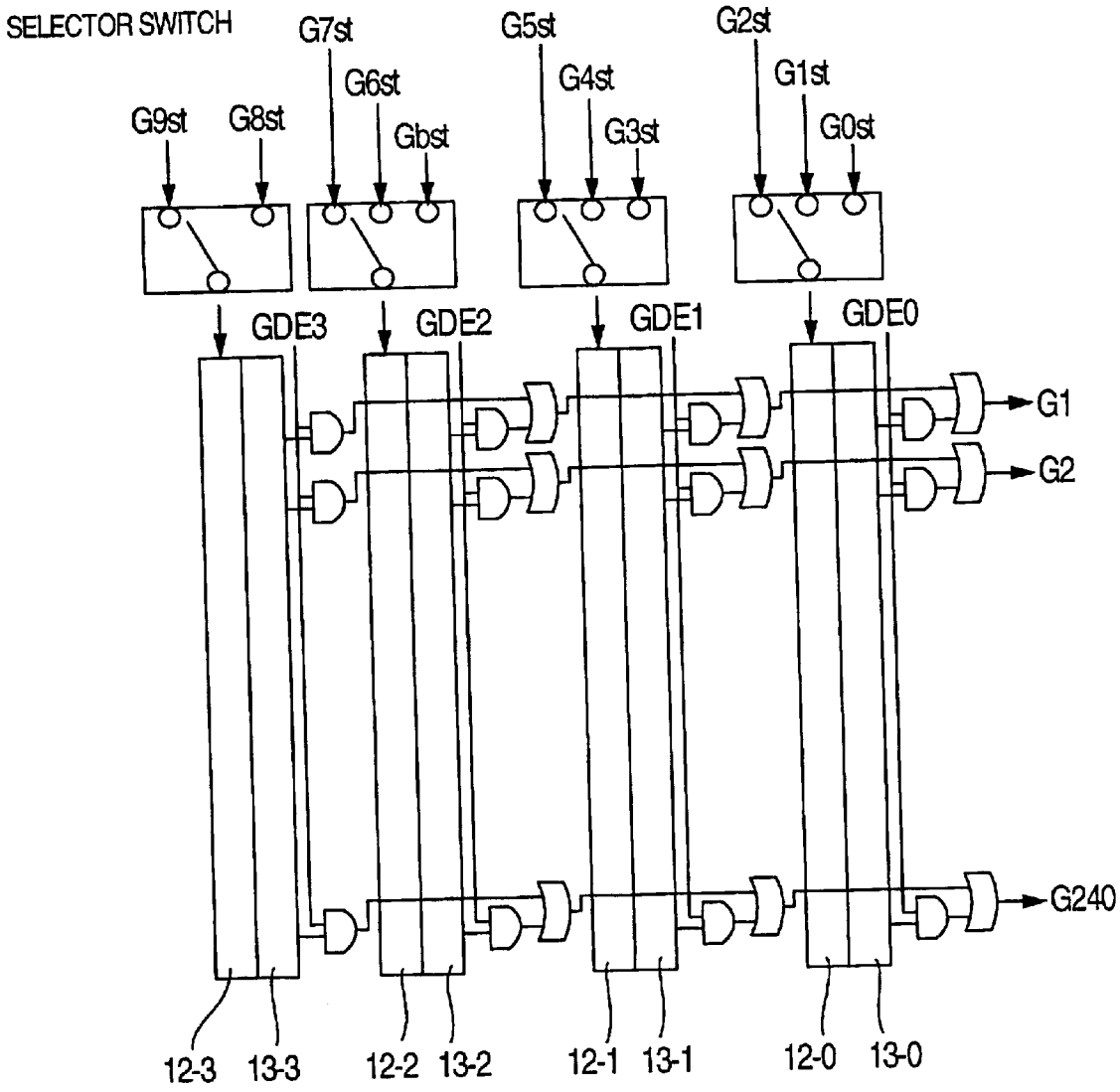
FIG. 17 is a constructional illustration the vertical driver of the seventh embodiment.
Figure 18:
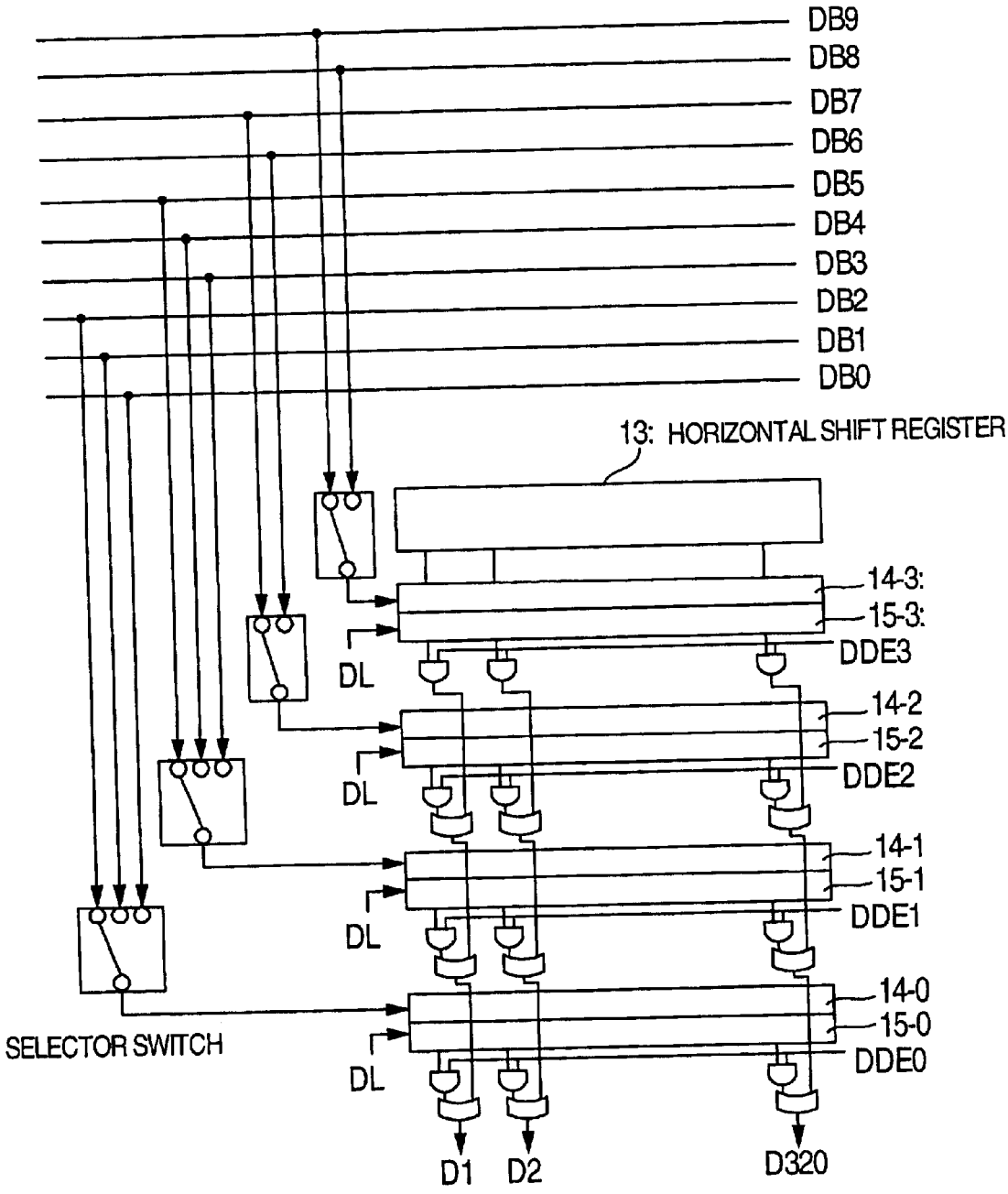
FIG. 18 is a constructional illustration the horizontal driver of the seventh embodiment.
Figure 19A:
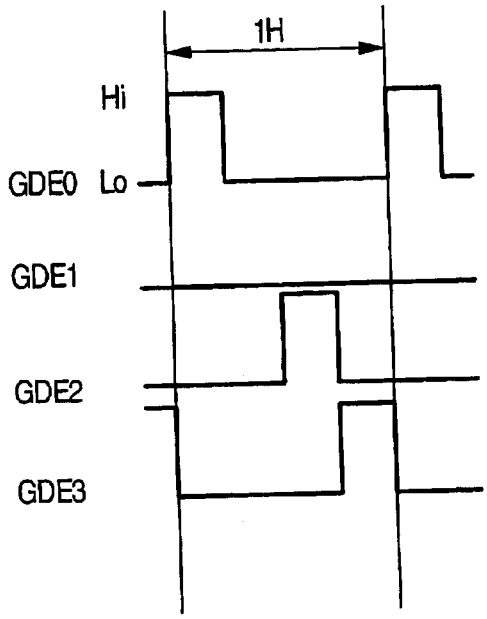
FIGS. 19A and 19B are drive waveforms to be applied to the vertical driver and the horizontal driver of the seventh embodiment.
Figure 19B:
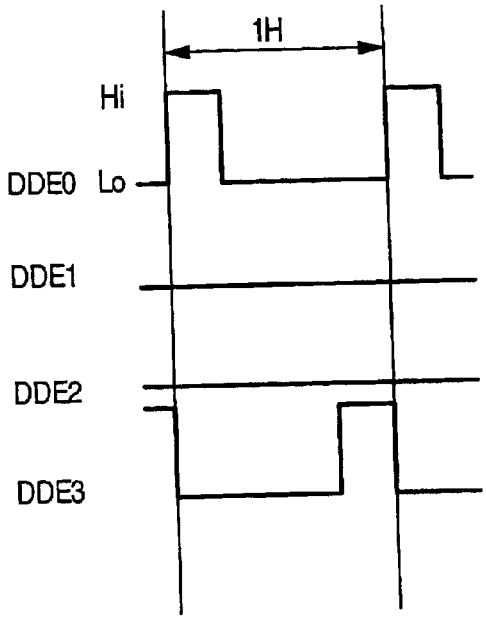

FIGS. 16A and 16B show a manner of multiplexed vertical scan when the maximum weight bit (b9 in the shown case) among 10 bit data is divided into two and period bb (area filled in black in the drawing) to be held in non-luminescence is provided in each frame to make the vertical scanning period longer and operation ratio of the circuit higher, and status of data output from each bit processing circuit. On the other hand, FIG. 17 shows a construction of the vertical drive circuit for realizing the operation shown in FIGS. 16A and 16B, and FIG. 18 shows a construction of the horizontal drive circuit for realizing the operation shown in FIGS. 16A and 16B. FIGS. 19A and 19B show part of drive waveforms to be applied to the vertical driver and the horizontal driver at a time indicated by t=tb in FIGS. 16A and 16B.

The non-luminescence period corresponds to the bit bb. The vertical drive circuit is additionally provided Gbst as input for the selector switch in order to output signal for outputting a selective scanning pulse from the bit processing circuit BC2. At this time, the drive wave forms to be applied to GDE is a pulse train as shown in FIG. 19A. The horizontal drive circuit is applied a pulse train as shown in FIG. 19B. However, so as not to output data for non-display, different from GDE2, output of DDE2 is held OFF.

For outputting such pulse train, comparing with the fifth embodiment, the circuit construction is unchanged except that combination of the bit data and the bit processing circuit is varied. By performing driving as shown in FIGS. 16A and 16B, the operation ratio Rmv=90% is achieved.

Seventh Embodiment

Figure 20:
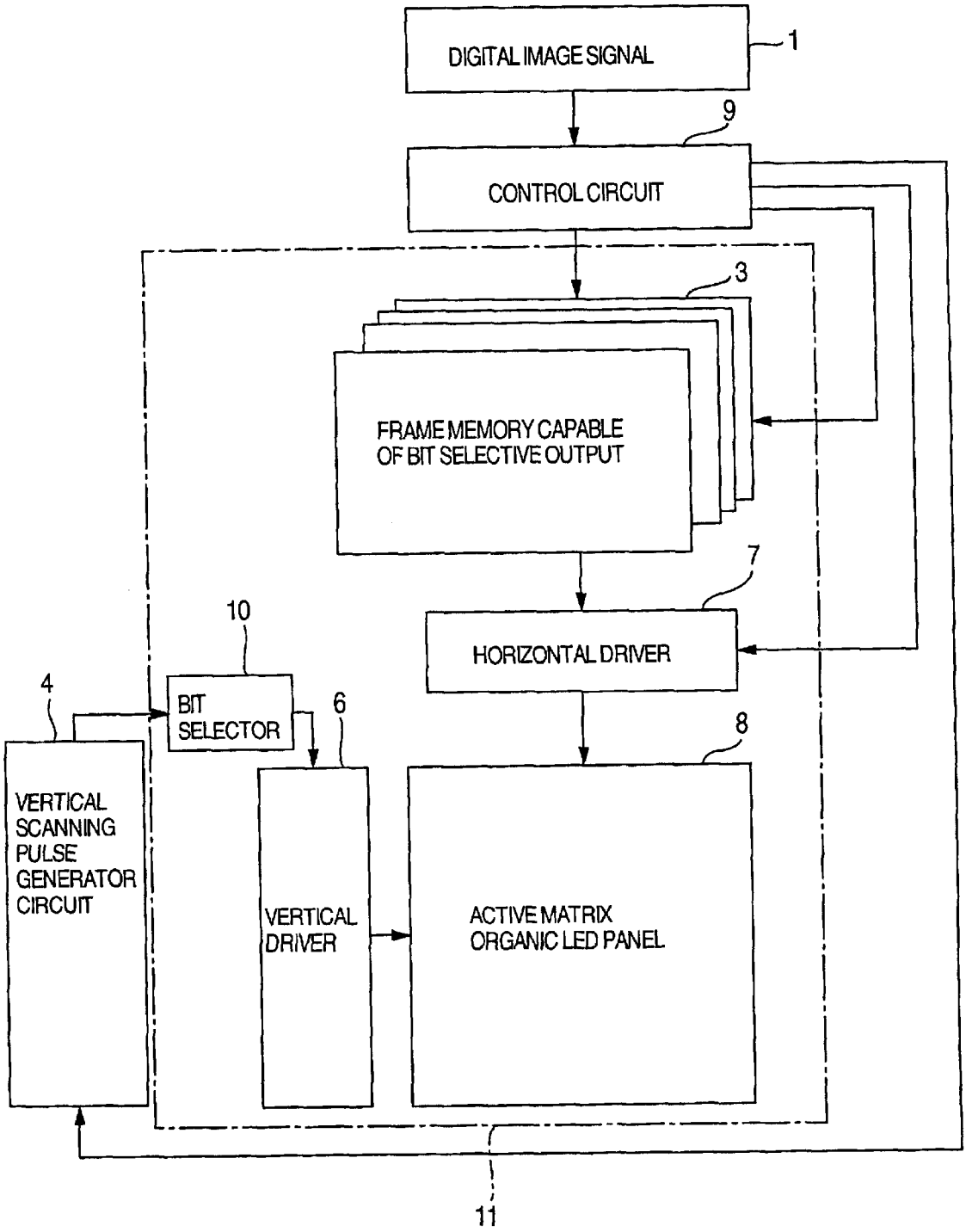
FIG. 20 is a block diagram of another embodiment of the image display apparatus according to the present invention.
Figure 21A:
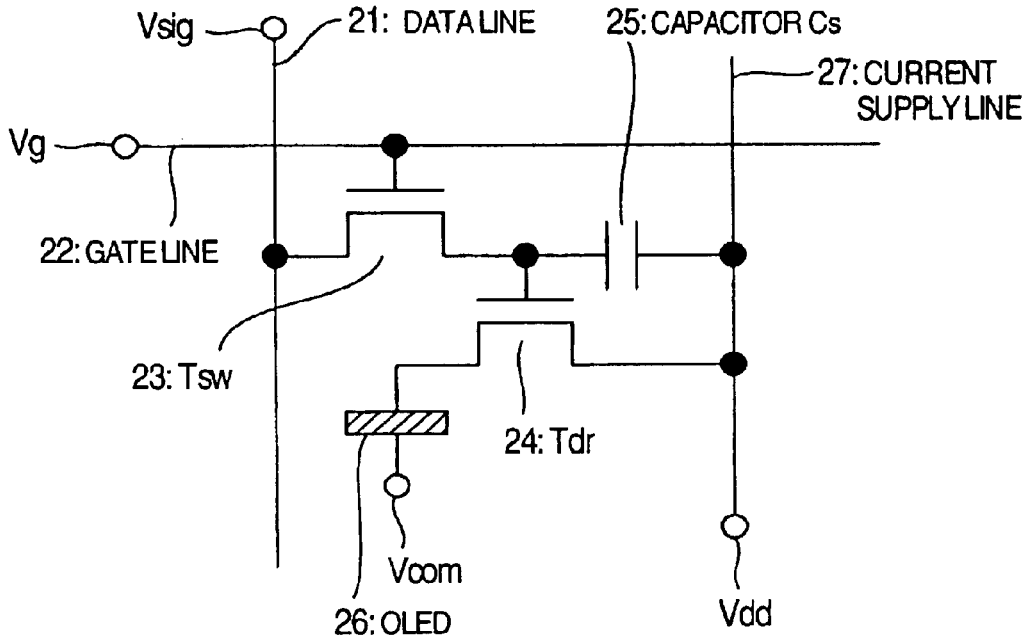
FIG.21A (PRIOR ART)
FIGS. 21A and 21B are explanatory illustration showing a pixel of an organic LED and a drive method in the prior art.
Figure 21B:
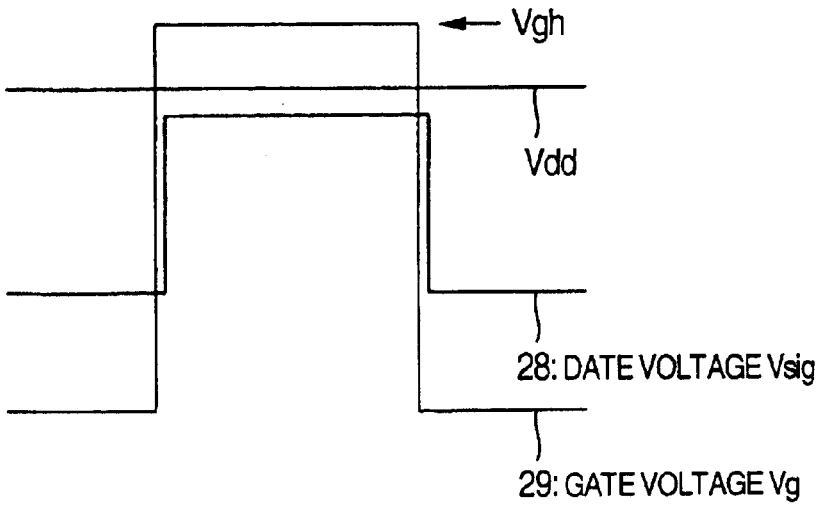
FIG.21B (PRIOR ART)
Figure 22:
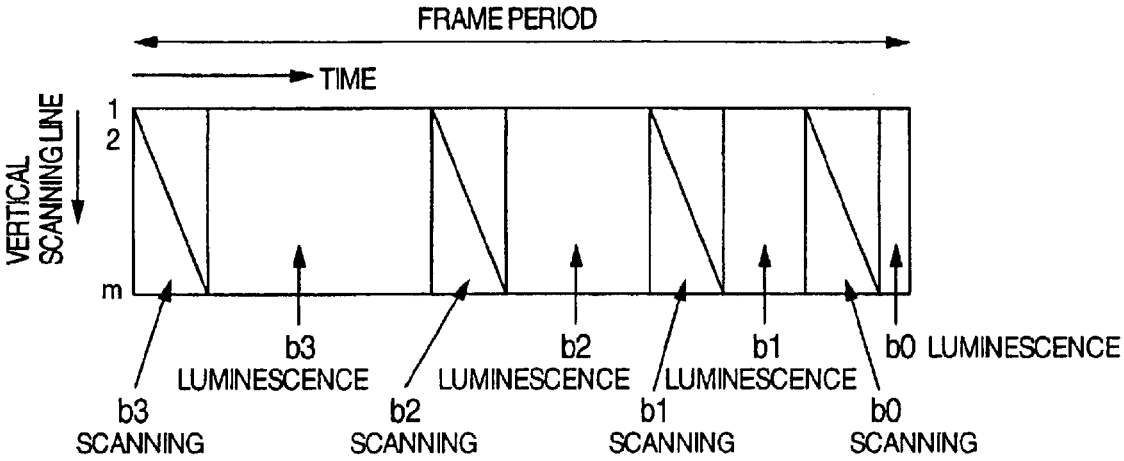
FIG.22 (PRIOR ART)
FIG. 22 is an explanatory illustration showing a digital drive diagram of the conventional organic LED.
Figure 23:
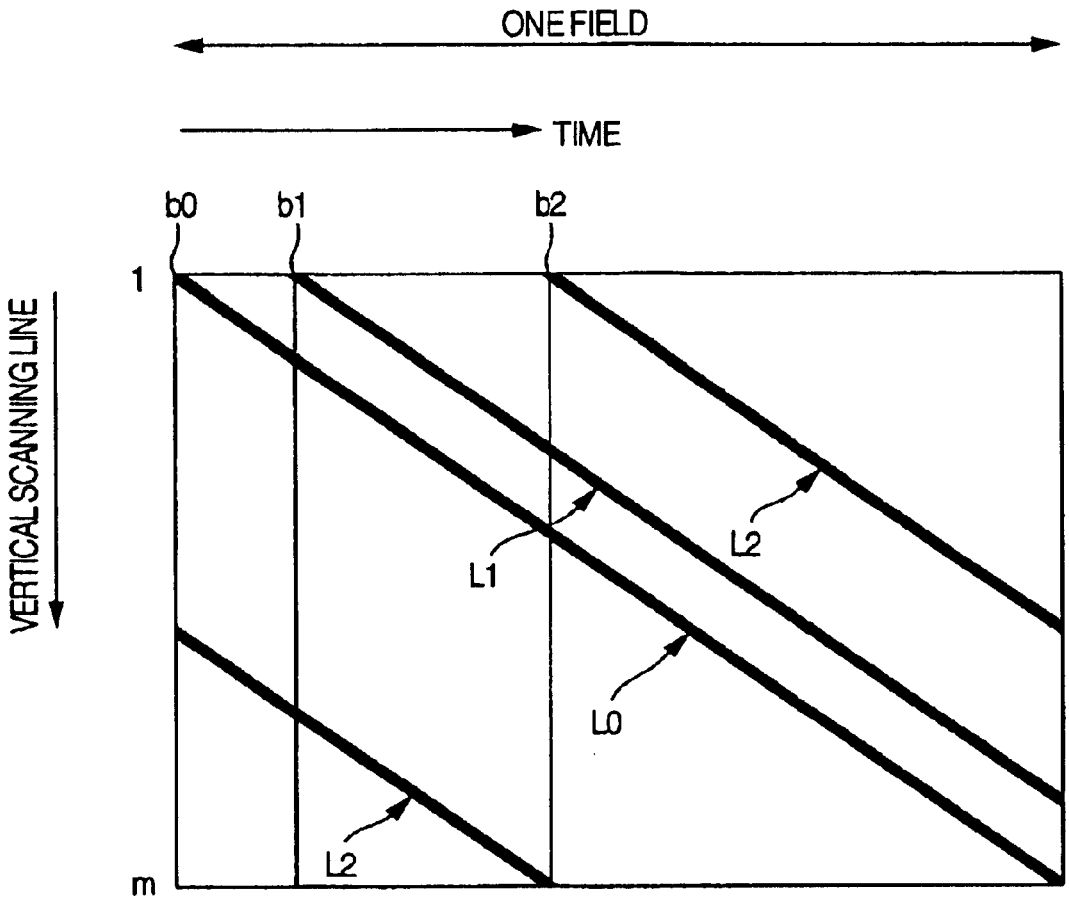
FIG.23 (PRIOR ART)
FIG. 23 is an explanatory illustration showing the drive diagram for multiplexing of vertical scan.

FIG. 20 shows a block construction of the case where a frame memory is mounted on the substrate forming the display portion. By mounting the frame memory on the same substrate, bit data taken from the memory in synchronism with vertical scan is directly input to the horizontal driver. In general, the frame memory adapted for m bit image data is consisted of m in number of memory planes to output m bit data simultaneously. When the frame memory is formed on the substrate, it becomes possible to designate not only the line but also the bit in the data address output from the memory in response to the control signal. By this, the horizontal driver may be constructed with single stage of line latch circuit to enable making the circuit scale smaller and power consumption lower.

With the present invention, in the image display element in which the display element is driven by controlling binary condition of the display element on the basis of the digital data, ratio occupied by the display period in one frame period becomes greater, and a period to be assigned for vertical scan becomes long to achieve bright and high quality image display, and as the same time to reduce load on the vertical drive circuit. Thus, even when number of gradation levels are increased, increasing of the circuit scale and power consumption can be restricted to realize low cost image display apparatus.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An image display apparatus for multiple tone display with number of gradation levels determined by number of bits of an image signal of m bit digital data, comprising:

a display having data holding function for holding data in pixels arranged on a matrix and performing display according to held data;

a vertical drive circuit sequentially and selectively scanning matrix form display elements forming said display per row;

a horizontal drive circuit writing a voltage among binary voltage preliminarily assigned depending upon the digital data of the image signal to be displayed in the display elements in the row selected by the vertical drive circuit, said horizontal drive circuit and said vertical drive circuit being operated for performing selective scan of respective display element for at least m times in one frame period in synchronism with said image signal to be displayed, and said vertical drive circuit being constituted of n in number of sequence circuits and logic operation circuits for outputs of said sequence circuits, which n is smaller than m, a period from inputting to said sequence circuit to outputting from the final stage being less than or equal to half of one frame period, and at least one of said sequence circuits being used with selectively inputting a plurality of inputs.

2. An image display apparatus for multiple tone display with number of gradation levels determined by number of bits of an image signal of m bit digital data, comprising:

a display having data holding function for holding data in pixels arranged on a matrix and performing display according to held data;

a vertical drive circuit sequentially and selectively scanning matrix form display elements forming said display per row;

a horizontal drive circuit writing a voltage among binary voltage preliminarily assigned depending upon the digital data of the image signal to be displayed in the display elements in the row selected by the vertical drive circuit, said horizontal drive circuit and said vertical drive circuit being operated for performing selective scan of respective display element for at least m times in one frame period in synchronism with said image signal to be displayed, and display period being preliminarily determined depending upon the digital data of the image signal to be displayed, and said vertical drive circuit being constituted of n in number of sequence circuits and logic operation circuits for outputs of said sequence circuits, which n is smaller than m, a period from inputting to said sequence circuit to outputting from the final stage being shorter than a minimum value of sums of arbitrarily selected sequentially input n bit display periods, and at least one of said sequence circuits being used with selectively inputting a plurality of inputs.

3. An image display apparatus as set forth in claim 2, wherein when a luminous period of the maximum weighted bit is longer than said period from inputting to said sequence circuit to outputting from the final stage, said luminous period is divided into half to be dividedly input by twice inputs on one frame period.

4. An image display apparatus as set forth in claim 1, wherein said vertical drive circuit generates a scanning pulse not corresponded to the digital data of said image signal and, for the row selectively scanned by said scanning pulse, all data from said horizontal drive circuit are held not displayed.

5. An image display apparatus for multiple tone display with number of gradation levels determined by number of bits of an image signal of m bit digital data, comprising:

a display having data holding function for holding data in pixels arranged on a matrix and performing display according to held data;

a vertical drive circuit sequentially and selectively scanning matrix form display elements forming said display per row;

a horizontal drive circuit writing a voltage among binary voltage preliminarily assigned depending upon the digital data of the image signal to be displayed in the display elements in the row selected by the vertical drive circuit, said horizontal drive circuit and said vertical drive circuit being operated for performing selective scan of respective display element for at least m times in one frame period in synchronism with said image signal to be displayed, and in synchronism with the row selectively scanned by said vertical drive circuit, said horizontal drive circuit being constituted of n in number of line data latch circuits, which n is smaller than m, a display signal for said display elements being output depending upon logical signals each contains a product of an output of the line data latch circuit per bit and a control signal dividing the horizontal scanning period, and at least one of said line data latch circuit being used with selectively inputting a plurality of inputs.

6. An image display apparatus as set forth in claim 1, wherein said vertical drive circuit determines a voltage to be applied to a vertical scanning line of said active matrix depending upon a result of sequentially summing of logical signals containing products of multiplication of result of logical operation of the outputs of said sequence circuits and control signals dividing the horizontal scanning period.

7. An image display apparatus as set forth in claim 5, wherein said display element includes a first thin film transistor connected to the vertical scanning line of said active matrix at gate and to horizontal scanning lines at drain, source of said first thin film transistor is connected to a gate of a second think film transistor and an electrode of a storage capacitor, and an organic LED is connected to said second think film transistor so that a current continuously flow through said organic LED during a period in which the image signal is held in said storage capacitor.

8. An image display apparatus as set forth in claim 5, wherein said vertical drive circuit and said horizontal drive circuit are formed with thin film transistors on an active matrix substrate.

9. An image display apparatus forming a display and a drive circuit on a substrate for performing multiple tone display with number of gradation levels determined by number of bits of an image signal of m bit digital data, comprising:

said drive circuit including a vertical drive circuit and a horizontal drive circuit, said vertical drive circuit being constituted of n in number of sequence circuits and logic operation circuits for outputs of said sequence circuits, which n is smaller than m, and at least one of said sequence circuits being used with selectively inputting a plurality of inputs.

10. An image display apparatus forming a display and a drive circuit on a substrate for performing multiple tone display with number of gradation-levels determined by number of bits of an image signal of m bit digital data, comprising:

said drive circuit including a vertical drive circuit and a horizontal drive circuit, said horizontal drive circuit being constituted of n in number of line data latch circuits and logic operation circuits for outputs of said sequence circuits, which n is smaller than m, and at least one of said line data latch circuits being input a plurality of bit data, said display being controlled depending upon a result by sequentially summing logical signals containing products of multiplication of output of the line data latch circuit per bit and the control signal dividing the horizontal scanning period.

11. An image display apparatus as set forth in claim 10, which performs multiple tone display of the image signal of 6-bit digital data by controlling display period weighted depending upon each bit in one frame, said vertical drive circuit includes three sequence circuits and logic operation circuits respectively connected to output ends of said sequence circuits, performs selective scan for respective display pixels for at least seven times in one frame with dividing luminous period of the bit at which the weight is maximum, and order of input of the bit data being determined so that a minimum value of sums of arbitrarily selected sequent three luminous period becomes greater than a period from inputting to said sequence circuit to outputting from the final stage.

12. An image display apparatus as set forth in claim 10, which performs multiple tone display of the image signal of 8-bit digital data by controlling display period weighted depending upon each bit in one frame, said vertical drive circuit includes three sequence circuits and logic operation circuits respectively connected to output ends of said sequence circuits, performs selective scan for respective display pixels for at least nine times in one frame with dividing luminous period of the bit at which the weight is maximum, and order of input of the bit data being determined so that a minimum value of sums of arbitrarily selected sequent three luminous period becomes greater than a period from inputting to said sequence circuit to outputting from the final stage.

* * * * *